US007371709B2

(12) United States Patent
Sakizadeh et al.

(10) Patent No.: US 7,371,709 B2
(45) **Date of Patent: *May 13, 2008**

(54) THERMALLY DEVELOPABLE MATERIALS WITH BACKSIDE ANTISTATIC LAYER

(76) Inventors: Kumars Sakizadeh, Eastman Kodak Company, One Imation Way, Oakdale, MN (US) 55128; Thomas J. Ludemann, Eastman Kodak Company, One Imation Way, Oakdale, MN (US) 55128; Gary E. LaBelle, Eastman Kodak Company, One Imation Way, Oakdale, MN (US) 55128

( * ) Notice: Subject to any disclaimer, the term of this patent is extended or adjusted under 35 U.S.C. 154(b) by 331 days.

This patent is subject to a terminal disclaimer.

(21) Appl. No.: 11/237,139

(22) Filed: Sep. 28, 2005

(65) Prior Publication Data

US 2007/0072772 A1 Mar. 29, 2007

(51) Int. Cl.
*B41M 5/40* (2006.01)

(52) U.S. Cl. ..... 503/201; 503/200; 503/207; 503/212; 503/226

(58) Field of Classification Search ..... None
See application file for complete search history.

(56) References Cited

U.S. PATENT DOCUMENTS

| | | | | |
|---|---|---|---|---|
| 3,854,942 | A * | 12/1974 | Akman | 430/47.5 |
| 4,074,000 | A * | 2/1978 | Hankee et al. | 428/323 |
| 5,340,676 | A | 8/1994 | Anderson et al. | |
| 5,348,849 | A | 9/1994 | Ito | |
| 5,368,995 | A | 11/1994 | Christian et al. | |
| 5,457,013 | A | 10/1995 | Christian et al. | |
| 5,731,119 | A | 3/1998 | Eichorst et al. | |
| 6,312,885 | B1 | 11/2001 | Fujita et al. | |
| 6,355,405 | B1 | 3/2002 | Ludemann et al. | |
| 6,464,413 | B2 | 10/2002 | Oyamada | |
| 6,689,546 | B1 | 2/2004 | LaBelle et al. | |
| 7,018,787 | B1 * | 3/2006 | Ludemann et al. | 430/353 |
| 7,022,467 | B1 * | 4/2006 | Ludemann et al. | 430/353 |
| 7,153,636 | B1 * | 12/2006 | Ludemann et al. | 430/353 |

FOREIGN PATENT DOCUMENTS

| | | | |
|---|---|---|---|
| EP | 1 406 120 | A2 | 4/2004 |
| JP | 2001-013660 | A | 1/2001 |
| JP | 2005-165173 | A | 6/2005 |

OTHER PUBLICATIONS

U.S. Appl. No. 10/930,428, filed Aug. 31, 2004 titled *Thermally Developable Materials With Backside Conductive Layer* by Ludemann et al.

U.S. Appl. No. 10/930,438, filed Aug. 31, 2004 titled *Improved Antistatic Properties For Thermally Developable Materials* by Ludemann et al.

U.S. Appl. No. 10/978,205, filed Oct. 29, 2004 titled *Thermally Developable Materials With Improved Conductive Layer* by Ludemann et al.

U.S. Appl. No. 11/000,115, filed Nov. 30, 2004 titled *Thermally Developable Materials Having Improved Backside Layers* by Ludemann et al.

U.S. Appl. No. 10/999,858, filed Nov. 30, 2004 titled *Thermally Developable Materials Having Improved Backside Conductive Layers* by Ludemann et al.

U.S. Appl. No. 11/053,088, filed Feb. 8, 2005 titled *Thermally Developable Materials With Improved Conductive Layer* by Ludemann et al.

* cited by examiner

*Primary Examiner*—Bruce H. Hess

(57) ABSTRACT

Thermally developable materials that comprise a support have an antistatic backside layer that includes a quaternary ammonium salt. The same or different backside layer can also include another antistatic agent such as conductive metal particles or conductive polymers. These thermally developable materials include both thermographic and photothermographic materials that can be suitably imaged to provide images useful for medical diagnoses.

18 Claims, No Drawings

THERMALLY DEVELOPABLE MATERIALS WITH BACKSIDE ANTISTATIC LAYER

FIELD OF THE INVENTION

This invention relates to thermally developable materials having backside conductive layers. In particular, this invention relates to thermographic and photothermographic materials having conductive backside layers containing quaternary ammonium salts. This invention also relates to methods of imaging using these thermally developable materials.

BACKGROUND OF THE INVENTION

Silver-containing thermographic and photothermographic imaging materials (that is, thermally developable imaging materials) that are imaged and/or developed using heat and without liquid processing have been known in the art for many years.

Silver-containing direct thermographic imaging materials are non-photosensitive materials that are used in a recording process wherein images are generated by the direct application of thermal energy and in the absence of a processing solvent. These materials generally comprise a support having disposed thereon (a) a relatively or completely non-photosensitive source of reducible silver ions, (b) a reducing composition (acting as a black-and-white silver developer) for the reducible silver ions, and (c) a suitable binder. Thermographic materials are sometimes called "direct thermal" materials in the art because they are directly imaged by a source of thermal energy without any transfer of the image or image-forming materials to another element (such as in thermal dye transfer).

In a typical thermographic construction, the image-forming thermographic layers comprise non-photosensitive reducible silver salts of long chain fatty acids. A preferred non-photosensitive reducible silver source is a silver salt of a long chain aliphatic carboxylic acid having from 10 to 30 carbon atoms, such as behenic acid or mixtures of acids of similar molecular weight. At elevated temperatures, the silver of the silver carboxylate is reduced by a reducing agent for silver ion (also known as a developer), whereby an image of elemental silver is formed. Preferred reducing agents include methyl gallate, hydroquinone, substituted-hydroquinones, hindered phenols, catechols, pyrogallol, ascorbic acid, and ascorbic acid derivatives.

Some thermographic constructions are imaged by contacting them with the thermal head of a thermographic recording apparatus such as a thermal print-head of a thermal printer or thermal facsimile. In such constructions, an anti-stick layer is coated on top of the imaging layer to prevent sticking of the thermographic construction to the thermal head of the apparatus utilized. The resulting thermographic construction is then heated imagewise to an elevated temperature, typically in the range of from about 60 to about 225° C., resulting in the formation of a black-and-white image.

Silver-containing photothermographic imaging materials (that is, photosensitive thermally developable imaging materials) that are imaged with actinic radiation and then developed using heat and without liquid processing have also been known in the art for many years. Such materials are used in a recording process wherein an image is formed by imagewise exposure of the photothermographic material to specific electromagnetic radiation (for example, X-radiation, or ultraviolet, visible, or infrared radiation) and developed by the use of thermal energy. These materials, also known as "dry silver" materials, generally comprise a support having coated thereon: (a) a photocatalyst (that is, a photosensitive compound such as silver halide) that upon such exposure provides a latent image in exposed grains that are capable of acting as a catalyst for the subsequent formation of a silver image in a development step, (b) a relatively or completely non-photosensitive source of reducible silver ions, (c) a reducing composition (usually including a developer) for the reducible silver ions, and (d) a suitable binder. The latent image is then developed by application of thermal energy.

In photothermographic materials, exposure of the photosensitive silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. This reaction occurs preferentially in the regions surrounding the latent image. This reaction produces a negative image of metallic silver having a color that ranges from yellow to deep black depending upon the presence of toning agents and other components in the photothermographic imaging layer(s).

Differences Between Photothermography and Photography

The imaging arts have long recognized that the field of photo-thermography is clearly distinct from that of photography. Photothermographic materials differ significantly from conventional silver halide photographic materials that require processing with aqueous processing solutions.

In photothermographic imaging materials, a visible image is created in the absence of a processing solvent by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example, a silver carboxylate or a silver benzotriazole) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself at least partially converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. The incorporation of the developer into photothermographic materials can lead to increased formation of various types of "fog" or other undesirable sensitometric side effects. Therefore, much effort has gone into the preparation and manufacture of photothermographic materials to minimize these problems.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Unconventional Imaging Processes,* E. Brinckman et al. (Eds.), The Focal Press, London and New York, 1978, pp. 74-75, in D. H. Klosterboer, *Imaging Processes and Materials,* (*Neblette's Eighth Edition*), J. Sturge, V. Walworth, and A. Shepp, Eds., Van Nostrand-Reinhold, New York, 1989, Chapter 9, pp. 279-291, in Zou et al., *J. Imaging Sci. Technol.* 1996, 40, pp. 94-103, and in M. R. V. Sahyun, *J. Imaging Sci. Technol.* 1998, 42, 23.

Problem to be Solved

Photothermographic and thermographic materials have been designed and commercialized with one or more backside (non-imaging side) layers for a number of years. Such layers are designed to have various functional properties including antistatic (or conductive), antihalation, protective, and improved machine feeding and transport properties. Efforts have been continuing to provide backside layers with improved functional properties as well as to reduce manufacturing and component costs.

Many of the chemicals used to make supports or supported layers in thermally developable materials have electrically insulating properties, and electrostatic charges frequently build up on the materials during manufacture, packaging, and use. The accumulated charges can cause various problems. For example, in photothermographic materials containing photosensitive silver halides, accumulated electrostatic charge can generate light to which the silver halides are sensitive. This may result in imaging defects that are a particular problem where the images are used for medical diagnosis.

Build-up of electrostatic charge can also cause sheets of thermally processable materials to stick together causing misfeeds and jamming within processing equipment. Additionally, accumulated electrostatic charge can attract dust or other particulate matter to the materials, thereby requiring more cleaning to insure rapid transport through the processing equipment and quality imaging.

Build-up of electrostatic charge also makes handling of developed sheets of imaged material more difficult. For example, radiologists desire a static free sheet for viewing on light boxes. This problem can be particularly severe when reviewing an imaged film that has been stored for a long period of time because many antistatic materials loose their effectiveness over time.

In general, electrostatic charge is related to surface resistivity (measured in log ohm/sq) and charge level. While electrostatic charge control agents (or antistatic agents) can be included in any layer of an imaging material, the accumulation of electrostatic charge can be prevented by reducing the surface resistivity or by lowering the charge level. These results can most often be achieved by including charge control agents in surface layers such as protective overcoats. In thermally processable materials, charge control agents may be used in backing layers that are on the opposite side of the support as the imaging layers.

A wide variety of charge control agents, both inorganic and organic, have been devised and used for electrostatic charge control. Metal oxides are described in conductive layers in U.S. Pat. No. 5,340,676 (Anderson et al.), U.S. Pat. No. 6,464,413 (Oyamada), U.S. Pat. No. 5,368,995 (Christian et al.), and U.S. Pat. No. 5,457,013 (Christian et al.). U.S. Pat. No. 5,731,119 (Eichorst et al.) describes the use of acicular metal oxides in aqueous-coated conductive layers for use in antistatic compositions.

U.S. Pat. No. 6,355,405 (Ludemann et al.) describes thermally developable materials that include very thin adhesion-promoting layers on either side of the support. These adhesion-promoting layers are also known as "carrier" layers. U.S. Pat. No. 6,689,546 (LaBelle et al.) describes thermally developable materials that contain a buried backside conductive "carrier" layer comprising non-acicular metal antimonate particles.

U.S. Pat. No. 5,348,849 (Ito) describes the use of various surfactants for various purposes in the preparation of hydrophilic colloid based photographic emulsion layers. Dodecyltrimethylammonium chloride is listed as a cationic surfactant.

U.S. Pat. No. 6,312,885 (Fujita et al.) describes dodecyltrimethyl-ammonium chloride as an emulsifier for the preparation of water-dispersible latexes used as binders for photothermographic emulsion layers.

Japanese Kokai 2001-013660 (Kazuhiko) describes the use of quaternary onium compounds as hardeners on the imaging side of photothermographic materials.

While the metal oxide particles described above are desirable antistatic agents, they are quite expensive and there is a need to reduce the amount used in conductive layers on the backside of photothermographic materials without a loss in conductive properties.

SUMMARY OF THE INVENTION

The present invention provides a thermally developable material that comprises a support having on one side thereof, one or more thermally developable imaging layers comprising a binder, the material also comprising, in reactive association, a non-photosensitive source of reducible silver ions, and a reducing agent composition for the non-photosensitive source of reducible silver ions, and having disposed on the backside of the support, a non-imaging backside layer comprising at least 0.0004 mol/m$^2$ of one or more a quaternary ammonium salts having a molecular weight less than 650 and comprising four aliphatic organic groups attached to the quaternary ammonium cation, provided at least one of the organic groups is an aliphatic group having 6 to 20 carbon atoms and at least two of the organic groups are the same or different aliphatic groups having i to 5 carbon atoms.

In some preferred embodiments, the thermally developable material comprises on the backside of the support:

a) a first non-imaging backside layer comprising a film-forming polymer and a one or more quaternary ammonium salts, and b) a buried backside layer being interposed between the support and the first non-imaging backside layer and directly adhering the first non-imaging backside layer to the support, the buried backside layer comprising non-acicular metal antimonate particles in a mixture of two or more polymers that include a first polymer serving to promote adhesion of the buried backside layer directly to the support, and a second polymer that is different than and forms a single phase mixture with the first polymer, wherein the film-forming polymer of the first non-imaging backside layer and the second polymer of the buried backside layer are the same or different polyvinyl acetal resins, polyester resins, cellulosic polymers, maleic anhydride-ester copolymers, or vinyl polymers.

This invention also provides a dry processable black-and-white photothermographic material that comprises a support having on one side thereof, one or more photothermographic layers comprising a binder, the material further comprising, in reactive association, a preformed photosensitive silver halide, a non-photosensitive source of reducible silver ions comprising at least one silver salt of a fatty acid, and a reducing agent composition for the non-photosensitive source reducible silver ions, and having disposed on the backside of the support:

a) a first non-imaging backside layer comprising a film-forming polymer, and b) interposed between the support and the first non-imaging backside layer and directly adhering the first non-imaging backside layer to the support, a buried backside layer comprising non-acicular metal antimonate particles in a mixture of two or more polymers that include a first polymer serving to promote adhesion of the buried backside layer directly to the support, and a second polymer that is different than and forms a single phase mixture with the first polymer, wherein the non-acicular metal antimonate particles are composed of zinc antimonate ($ZnSb_2O_6$) and comprise greater than 70 and up to 76% by dry weight of the buried backside layer, are present at a coverage of from about 0.06 to about 0.2 g/m$^2$, and the ratio of total binder polymers in the buried backside layer to the non-acicular metal antimonate particles is less than 0.75:1, based on dry weights, and the dry thickness of the buried backside layer is from about 0.09 to about 0.2 μm, wherein the film-forming polymer of the first non-imaging backside layer and the second polymer of the buried backside layer are the same or different polyvinyl acetal resins, polyester resins, cellulosic polymers, maleic anhydride-ester copolymers, or vinyl polymers, and the first non-imaging backside layer further comprises from about 0.0004 to about 0.0025 mol/m$^2$ of a quaternary ammonium salt that can be represented by the following Structure (I):

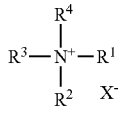

(I)

wherein $R^1$ is an alkyl group having 6 to 20 carbon atoms, and $R^2$, $R^3$, and $R^4$ are independently alkyl groups having 1 to 53 carbon atoms, and X− is chloride.

This invention further provides a method of forming a visible image comprising:

A) imagewise exposing the material of this invention that is a photothermographic material to electromagnetic radiation to form a latent image, and B) simultaneously or sequentially, heating the exposed photothermographic material to develop the latent image into a visible image.

The method of this invention can also provide a visible image by thermal imaging of the material of this invention that is a thermographic material.

This invention further provides a method of forming a visible image in a thermographic material of this invention that comprises:

(A') thermal imaging of the thermographic material.

This invention also provides a method for forming a visible image in a photothermographic material of this invention comprising:

(A) imagewise exposing the photothermographic material to radiation to form a latent image, and (B) simultaneously or sequentially, heating the exposed photothermographic material to develop the latent image into a visible image.

The present invention provides a means for providing exceptional conductivity on the backside of thermally developable materials with the incorporation of certain quaternary ammonium salts in one or more backside layers

DETAILED DESCRIPTION OF THE INVENTION

The thermally developable materials described herein are both thermographic and photothermographic materials. While the following discussion will often be directed primarily to the preferred photothermographic embodiments, it would be readily understood by one skilled in the art that thermographic materials can be similarly constructed and used to provide black-and-white or color images using appropriate imaging chemistry and particularly non-photosensitive organic silver salts, reducing agents, toners, binders, and other components known to a skilled artisan. In both thermographic and photothermographic materials, the quaternary ammonium salts described herein are incorporated into one or more backside layers.

The thermally developable materials of this invention can be used in black-and-white or color thermography and photothermography and in electronically generated black-and-white or color hardcopy recording. They can be used in microfilm applications, in radiographic imaging (for example digital medical imaging), X-ray radiography, and in industrial radiography. Furthermore, the absorbance of these materials between 350 and 450 nm is desirably low (less than 0.5), to permit their use in the graphic arts area (for example, imagesetting and phototypesetting), in the manufacture of printing plates, in contact printing, in duplicating ("duping"), and in proofing.

The thermally developable materials are particularly useful for imaging of human or animal subjects in response to visible, X-radiation, or infrared radiation for use in a medical diagnosis. Such applications include, but are not limited to, thoracic imaging, mammography, dental imaging, orthopedic imaging, general medical radiography, therapeutic radiography, veterinary radiography, and autoradiography. When used with X-radiation, the photothermographic materials may be used in combination with one or more phosphor intensifying screens, with phosphors incorporated within the photothermographic emulsion, or with combinations thereof. Such materials are particularly useful for dental radiography when they are directly imaged by X-radiation. The materials are also useful for non-medical uses of X-radiation such as X-ray lithography and industrial radiography.

The photothermographic materials can be made sensitive to radiation of any suitable wavelength. Thus, in some embodiments, the materials are sensitive at ultraviolet, visible, infrared, or near infrared wavelengths, of the electromagnetic spectrum. In preferred embodiments, the materials are sensitive to radiation at 700 nm or greater (and generally from about 750 up to about 950 nm). Increased sensitivity to a particular region of the spectrum is imparted through the use of various spectral sensitizing dyes.

In the photothermographic materials, the components needed for imaging can be in one or more photothermographic imaging layers on one side ("frontside") of the support. As the materials contain imaging layers on one side of the support only, various non-imaging layers are usually disposed on the "backside" (non-emulsion or non-imaging side) of the materials, including at least one layer containing the quaternary ammonium salts described herein, and optionally antihalation layer(s), protective layers, and transport enabling layers.

Various non-imaging layers can also be disposed on the "frontside" or imaging or emulsion side of the support, including protective frontside topcoat layers, primer layers, interlayers, opacifying layers, antistatic layers, antihalation layers, acutance layers, auxiliary layers, and other layers readily apparent to one skilled in the art.

When the thermally developable materials are heat-developed as described below in a substantially water-free condition after, or simultaneously with, imagewise exposure, a silver image (preferably a black-and-white silver image) is obtained.

Definitions

As used herein:

In the descriptions of the thermally developable materials, "a" or "an" component refers to "at least one" of that component (for example, the specific quaternary ammonium salts described herein).

As used herein, "black-and-white" refers to an image formed by silver metal.

Unless otherwise indicated, when the terms "thermally developable materials," "photothermographic materials," and "thermographic materials" are used herein, the terms refer to materials of the present invention.

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water or any other solvent for inducing or promoting the reaction is not particularly or positively supplied from the exterior to the material. Such a condition is described in T. H. James, *The Theory of the Photographic Process,* Fourth Edition, Eastman Kodak Company, Rochester. N.Y., 1977, p. 374.

"Photothermographic material(s)" means a dry processable integral element comprising a support and at least one photothermographic layer or a photothermographic set of emulsion layers (wherein the photosensitive silver halide and the source of reducible silver ions are in one layers and the other necessary components or additives are distributed, as desired, in the same layer or in an adjacent coated layer) that provides a black-and-white silver image. These materials also include multilayer constructions in which one or more imaging components are in different photothermographic layers, but are in "reactive association". For example, one layer can include the non-photosensitive source of reducible silver ions and another layer can include the reducing composition, but the two reactive components are in reactive association with each other. By "integral", we mean that all imaging chemistry required for imaging is in the material without diffusion of imaging chemistry or reaction products (such as a dye) from or to another element (such as a receiver element).

"Thermographic materials" are similarly defined except that no photosensitive silver halide catalyst is purposely added or created.

When used in photothermography, the term, "imagewise exposing" or "imagewise exposure" means that the material is imaged using any exposure means that provides a latent image using electromagnetic radiation. This includes, for example, by analog exposure where an image is formed by projection onto the photosensitive material as well as by digital exposure where the image is formed one pixel at a time such as by modulation of scanning laser radiation.

When used in thermography, the term, "imagewise exposing" or "imagewise exposure" means that the material is imaged using any means that provides an image using heat. This includes, for example, by analog exposure where an image is formed by differential contact heating through a mask using a thermal blanket or infrared heat source, as well as by digital exposure where the image is formed one pixel at a time such as by modulation of thermal print-heads or by thermal heating using scanning laser radiation.

"Catalytic proximity" or "reactive association" means that the reactive components are in the same layer or in adjacent layers so that they readily come into contact with each other during imaging and thermal development.

"Emulsion layer," "imaging layer," "thermographic emulsion layer," or "photothermographic emulsion layer" means a layer of a thermographic or photothermographic material that contains the photosensitive silver halide (when used) and/or non-photosensitive source of reducible silver ions, or a reducing composition. Such layers can also contain additional components or desirable additives. These layers are on what is referred to as the "frontside" of the support.

"Photocatalyst" means a photosensitive compound such as silver halide that, upon exposure to radiation, provides a compound that is capable of acting as a catalyst for the subsequent development of the image-forming material. In photothermographic materials, the photocatalyst and the non-photosensitive source of reducible silver ions are in catalytic proximity and preferably are in the same emulsion layer.

"Simultaneous coating" or "wet-on-wet" coating means that when multiple layers are coated, subsequent layers are coated onto the initially coated layer before the initially coated layer is dry. Simultaneous coating can be used to apply layers on the frontside, backside, or both sides of the support.

"Ultraviolet region of the spectrum" refers to that region of the spectrum less than or equal to 410 nm (preferably from about 100 nm to about 410 nm) although parts of these ranges may be visible to the naked human eye.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive.

The sensitometric terms "photospeed," "speed," or "photographic speed" (also known as sensitivity), absorbance, and contrast have conventional definitions known in the imaging arts. The sensitometric term absorbance is another term for optical density (OD).

"Transparent" means capable of transmitting visible light or imaging radiation without appreciable scattering or absorption.

The phrases "silver salt," and "organic silver salt" refer to an organic molecule having a bond to a silver atom. Although the compounds so formed are technically silver coordination complexes or silver compounds they are also often referred to as silver salts.

As used herein, the term "organic group" has its customary meaning and the term aliphatic organic group refers to straight or branched chain hydrocarbons such as alkanes, alkenes, or alkynes.

The term "buried layer" means that there is at least one other layer disposed over the layer (such as a "buried" backside conductive layer).

The terms "coating weight," "coat weight," and "coverage" are synonymous, and are usually expressed in weight per unit area such as $g/m^2$.

"Conductive efficiency" refers to the amount of conductive particles necessary to achieve a given conductivity. Samples with a high conductive efficiency require fewer conductive particles to achieve a given conductivity than those of a comparative sample. Alternatively, conductive efficiency can also refer to samples having a higher conductivity with the same number of particles (that is, the same coating weight).

As is well understood in this art, for the chemical compounds herein described, substitution is not only tolerated, but is often advisable and various substituents are anticipated on the compounds used in the present invention unless otherwise stated. Thus, when a compound is referred to as "having the structure" of a given formula, any substitution that does not alter the bond structure of the formula or the shown atoms within that structure is included within the formula, unless such substitution is specifically excluded by language.

As a means of simplifying the discussion and recitation of certain substituent groups, the term "group" refers to chemical species that may be substituted as well as those that are not so substituted. Thus, the term "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group includes aminoalkyl, ether, and thioether groups (for example $CH_3—CH_2—CH_2—N(CH_3)—CH_2—$, $CH_3—CH_2—CH_2—O—CH_2—$ and $CH_3—CH_2—CH_2—S—CH_2—$), haloalkyl, nitroalkyl, alkylcarboxy, carboxyalkyl, carboxamido, hydroxyalkyl, sulfoalkyl, and other groups readily apparent to one skilled in the art. A skilled artisan would exclude substituents that adversely react with other active ingredients, such as very strongly electrophilic or oxidizing substituents, as not being inert or harmless.

*Research Disclosure* (http://www.researchdisclosure.com) is a publication of Kenneth Mason Publications Ltd., The Book Barn, Westbourne, Hampshire PO10 8RS, UK. It is also available from Emsworth Design Inc., 200 Park Avenue South, Room 1101, New York, N.Y. 10003.

Other aspects, advantages, and benefits of the present invention are apparent from the detailed description, examples, and claims provided in this application.

The Photocatalyst

As noted above, photothermographic materials include one or more photocatalysts in the photothermographic emulsion layer(s). Useful photo-catalysts are typically photosensitive silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. Silver bromide and silver bromoiodide are more preferred. More preferred is silver bromoiodide in which any suitable amount of iodide is present up to almost 100 mole % iodide. Even more preferably, the silver bromoiodide comprises at least 70 mole % (preferably at least 80 mole %, and most preferably at least 90 mole %) bromide (based on total silver halide). The remainder of the halide is either iodide or chloride and iodide. Preferably, the additional halide is iodide. Silver bromide and silver bromoiodide are most preferred, with the latter silver halide generally having up to 10 mol % silver iodide.

In some embodiments of aqueous-based photothermographic materials, higher amounts of iodide may be present in homogeneous photo-sensitive silver halide grains, and particularly from about 20 mol % up to the saturation limit of iodide as described, for example, U.S. Patent Application Publication 2004/0053173 (Maskasky et al.).

The silver halide grains may have any crystalline habit or morphology including, but not limited to, cubic, octahedral, tetrahedral, orthorhombic, rhombic, dodecahedral, other polyhedral, tabular, laminar, twinned, or platelet morphologies and may have epitaxial growth of crystals thereon. If desired, a mixture of grains with different morphologies can be employed. Silver halide grains having cubic and tabular morphology (or both) are preferred.

The silver halide grains may have a uniform ratio of halide throughout. They may also have a graded halide content, with a continuously varying ratio of, for example, silver bromide and silver iodide or they may be of the core-shell type, having a discrete core of one or more silver halides, and a discrete shell of one or more different silver halides. Core-shell silver halide grains useful in photothermographic materials and methods of preparing these materials are described in U.S. Pat. No. 5,382,504 (Shor et al.), incorporated herein by reference. Iridium and/or copper doped core-shell and non-core-shell grains are described in U.S. Pat. No. 5,434,043 (Zou et al.) and U.S. Pat. No. 5,939,249 (Zou), both incorporated herein by reference.

In some instances, it may be helpful to prepare the photosensitive silver halide grains in the presence of a hydroxytetrazaindene (such as 4-hydroxy-6-methyl-1,3,3a,7-tetrazaindene) or an N-heterocyclic compound comprising at least one mercapto group (such as 1-phenyl-5-mercaptotetrazole) as described in U.S. Pat. No. 6,413,710 (Shor et al.) that is incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halides be preformed and prepared by an ex-situ process. With this technique, one has the possibility of more precisely controlling the grain size, grain size distribution, dopant levels, and composition of the silver halide, so that one can impart more specific properties to both the silver halide grains and the resulting photothermographic material.

In some constructions, it is preferable to form the non-photo-sensitive source of reducible silver ions in the presence of ex-situ-prepared silver halide. In this process, the source of reducible silver ions, such as a long chain fatty acid silver carboxylate (commonly referred to as a silver "soap" or homogenate), is formed in the presence of the preformed silver halide grains. Co-precipitation of the source of reducible silver ions in the presence of silver halide provides a more intimate mixture of the two materials [see U.S. Pat. No. 3,839,049 (Simons)] to provide a material often referred to as a "preformed soap".

In some embodiments, it is preferred that preformed silver halide grains be added to and "physically mixed" with the non-photosensitive source of reducible silver ions.

Preformed silver halide emulsions can be prepared by aqueous or organic processes and can be unwashed or washed to remove soluble salts. Soluble salts can be removed by any desired procedure for example as described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.), and U.S. Pat. No. 2,489,341 (Waller et al.).

It is also effective to use an in-situ process in which a halide- or a halogen-containing compound is added to an organic silver salt to partially convert the silver of the organic silver salt to silver halide. Inorganic halides (such as zinc bromide, zinc iodide, calcium bromide, lithium bromide, lithium iodide, or mixtures thereof) or an organic halogen-containing compound (such as N-bromo-succinimide or pyridinium hydrobromide perbromide) can be used. The details of such in-situ generation of silver halide are well known and described in U.S. Pat. No. 3,457,075 (Morgan et al.).

It is particularly effective to use a mixture of both preformed and in-situ generated silver halide. The preformed silver halide is preferably present in a preformed soap.

Additional methods of preparing silver halides and organic silver salts and blending them are described in *Research Disclosure,* June 1978, item 17029, U.S. Pat. No. 3,700,458 (Lindholm) and U.S. Pat. No. 4,076,539 (Ikenoue et al.), Japanese Kokai 49-013224 (Fuji), 50-017216 (Fuji), and 51-042529 (Fuji).

The silver halide grains used in the imaging formulations can vary in average diameter of up to several micrometers (μm) depending on the desired use. Preferred silver halide grains for use in preformed emulsions containing silver carboxylates are cubic grains having an average particle size of from about 0.01 to about 1.5 μm, more preferred are those having an average particle size of from about 0.03 to about 1.0 μm, and most preferred are those having an average particle size of from about 0.03 to about 0.1 μm. Preferred silver halide grains for high-speed photothermographic use are tabular grains having an average thickness of at least 0.02 μm and up to and including 0.10 μm, an equivalent circular diameter of at least 0.5 μm and up to and including 8 μm and an aspect ratio of at least 5:1. More preferred are those having an average thickness of at least 0.03 μm and up to and including 0.08 μm, an equivalent circular diameter of at least 0.75 μm and up to and including 6 μm and an aspect ratio of at least 10:1.

The average size of the photosensitive silver halide grains is expressed by the average diameter if the grains are spherical, and by the average of the diameters of equivalent circles for the projected images if the grains are cubic or in other non-spherical shapes. Representative grain sizing methods are described in *Particle Size Analysis,* ASTM Symposium on Light Microscopy, R. P. Loveland, 1955, pp. 94-122, and in C. E. K. Mees and T. H. James, *The Theory of the Photographic Process,* Third Edition, Macmillan, N.Y., 1966. Chapter 2. Particle size measurements may be expressed in terms of the projected areas of grains or approximations of their diameters. These will provide reasonably accurate results if the grains of interest are substantially uniform in shape.

The one or more light-sensitive silver halides are preferably present in an amount of from about 0.005 to about 0.5 mole, more preferably from about 0.01 to about 0.25 mole, and most preferably from about 0.03 to about 0.15 mole, per mole of non-photosensitive source of reducible silver ions.

Chemical Sensitization

The photosensitive silver halides can be chemically sensitized using any useful compound that contains sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process,* Fourth Edition, Eastman Kodak Company, Rochester, N.Y., 1977, Chapter 5, pp. 149-169. Suitable conventional chemical sensitization procedures are also described in U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), and U.S. Pat. No. 5,759,761 (Lushington et al.), and EP 0 915 371A1 (Lok et al.), all of which are incorporated herein by reference.

Mercaptotetrazoles and tetraazindenes as described in U.S. Pat. No. 5,691,127 (Daubendiek et al.), incorporated herein by reference, can also be used as suitable addenda for tabular silver halide grains.

Certain substituted and unsubstituted thiourea compounds can be used as chemical sensitizers including those described in U.S. Pat. No. 6,368,779 (Lynch et al.) that is incorporated herein by reference.

Still other additional chemical sensitizers include certain tellurium-containing compounds that are described in U.S. Pat. No. 6,699,647 (Lynch et al.), and certain selenium-containing compounds that are described in U.S. Pat. No. 6,620,577 (Lynch et al.), that are both incorporated herein by reference.

Combinations of gold(III)-containing compounds and either sulfur-, tellurium-, or selenium-containing compounds are also useful as chemical sensitizers as described in U.S. Pat. No. 6,423,481 (Simpson et al.) that is also incorporated herein by reference.

In addition, sulfur-containing compounds can be decomposed on silver halide grains in an oxidizing environment according to the teaching in U.S. Pat. No. 5,891,615 (Winslow et al.). Examples of sulfur-containing compounds that can be used in this fashion include sulfur-containing spectral sensitizing dyes. Other useful sulfur-containing chemical sensitizing compounds that can be decomposed in an oxidized environment are the diphenylphosphine sulfide compounds described in copending and commonly assigned U.S. Patent Application Publication 2005/0123870 (Simpson et al.). Both the above patent and patent application publication are incorporated herein by reference.

The chemical sensitizers can be present in conventional amounts that generally depend upon the average size of the silver halide grains. Generally, the total amount is at least $10^{-10}$ mole per mole of total silver, and preferably from about $10^{-8}$ to about $10^{-2}$ mole per mole of total silver for silver halide grains having an average size of from about 0.01 to about 2 μm.

Spectral Sensitization

The photosensitive silver halides may be spectrally sensitized with one or more spectral sensitizing dyes that are known to enhance silver halide sensitivity to ultraviolet, visible, and/or infrared radiation (that is, sensitivity within the range of from about 300 to about 1400 nm). Non-limiting examples of spectral sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. They may be added at any stage in chemical finishing of the photothermographic emulsion, but are generally added after chemical sensitization is achieved.

Suitable spectral sensitizing dyes such as those described in U.S. Pat. No. 3,719,495 (Lea), U.S. Pat. No. 4,396,712 (Kinoshita et al.), U.S. Pat. No. 4,439,520 (Kofron et al.), U.S. Pat. No. 4,690,883 (Kubodera et al.), U.S. Pat. No. 4,840,882 (Iwagaki et al.), U.S. Pat. No. 5,064,753 (Kohno et al.), U.S. Pat. No. 5,281,515 (Delprato et al.), U.S. Pat. No. 5,393,654 (Burrows et al.), U.S. Pat. No. 5,441,866 (Miller et al.), U.S. Pat. No. 5,508,162 (Dankosh), U.S. Pat. No. 5,510,236 (Dankosh), and U.S. Pat. No. 5,541,054 (Miller et al.), Japanese Kokai 2000-063690 (Tanaka et al.), 2000-112054 (Fukusaka et al.), 2000-273329 (Tanaka et al.), 2001-005145 (Arai), 2001-064527 (Oshiyama et al.), and 2001-154305 (Kita et al.), can be used in the practice of the invention. Useful spectral sensitizing dyes are also described in *Research Disclosure,* December 1989, item 308119, Section IV and *Research Disclosure,* 1994, item 36544, section V. All of the publications noted above are incorporated herein by reference.

Teachings relating to specific combinations of spectral sensitizing dyes also include U.S. Pat. No. 4,581,329 (Sugimoto et al.), U.S. Pat. No. 4,582,786 (Ikeda et al.), U.S. Pat. No. 4,609,621 (Sugimoto et al.), U.S. Pat. No. 4,675,279 (Shuto et al.), U.S. Pat. No. 4,678,741 (Yamada et al.), U.S. Pat. No. 4,720,451 (Shuto et al.), U.S. Pat. No. 4,818,675 (Miyasaka et al.), U.S. Pat. No. 4,945,036 (Arai et al.), and U.S. Pat. No. 4,952,491 (Nishikawa et al.). All of the above publications and patents are incorporated herein by reference.

Also useful are spectral sensitizing dyes that decolorize by the action of light or heat as described in U.S. Pat. No. 4,524,128 (Edwards et al.), Japanese Kokai 2001-109101 (Adachi), 2001-154305 (Kita et al.), and 2001-183770 (Hanyu et al.), all incorporated herein by reference.

Dyes may be selected for the purpose of supersensitization to attain much higher sensitivity than the sum of sensitivities that can be achieved by using each dye alone.

An appropriate amount of spectral sensitizing dye added is generally about $10^{-10}$ to $10^{-1}$ mole, and preferably, about $10^{-7}$ to $10^{-2}$ mole per mole of silver halide.

Non-Photosensitive Source of Reducible Silver Ions

The non-photosensitive source of reducible silver ions in the thermally developable materials is a silver-organic compound that contains reducible silver(I) ions. Such compounds are generally silver salts of silver organic coordinating ligands that are comparatively stable to light and form a silver image when heated to 50° C. or higher in the presence of an exposed photocatalyst (such as silver halide, when used in a photothermographic material) and a reducing agent composition.

The primary organic silver salt is often a silver salt of an aliphatic carboxylate (described below). Mixtures of silver salts of aliphatic carboxylates are particularly useful where the mixture includes at least silver behenate.

Useful silver carboxylates include silver salts of long-chain aliphatic carboxylic acids. These aliphatic carboxylic acids, often referred to as "fatty acids" generally have aliphatic chains that contain 10 to 30, and preferably 15 to 28, carbon atoms. Examples of such preferred silver salts include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Most preferably, at least silver behenate is used alone or in mixtures with other silver carboxylates.

Silver salts other than the silver carboxylates described above can be used also. Such silver salts include silver salts of aliphatic carboxylic acids containing a thioether group as described in U.S. Pat. No. 3,330,663 (Weyde et al.), soluble silver carboxylates comprising hydrocarbon chains incorporating ether or thioether linkages or sterically hindered substitution in the α-(on a hydrocarbon group) or ortho-(on an aromatic group) position as described in U.S. Pat. No. 5,491,059 (Whitcomb), silver salts of dicarboxylic acids, silver salts of sulfonates as described in U.S. Pat. No. 4,504,575 (Lee), silver salts of sulfosuccinates as described in EP 0 227 141A1 (Leenders et al.), silver salts of aromatic carboxylic acids (such as silver benzoate), silver salts of acetylenes as described, for example in U.S. Pat. No. 4,761,361 (Ozaki et al.) and U.S. Pat. No. 4,775,613 (Hirai et al.), and silver salts of heterocyclic compounds containing mercapto or thione groups and derivatives as described in U.S. Pat. No. 4,123,274 (Knight et al.) and U.S. Pat. No. 3,785,830 (Sullivan et al.).

It is also convenient to use silver half soaps such as an equimolar blend of silver carboxylate and carboxylic acid that analyzes for about 14.5% by weight solids of silver in the blend and that is prepared by precipitation from an aqueous solution of an ammonium or an alkali metal salt of a commercially available fatty carboxylic acid, or by addition of the free fatty acid to the silver soap.

The methods used for making silver soap emulsions are well known in the art and are disclosed in *Research Disclosure,* April 1983, item 22812, *Research Disclosure,* October 1983, item 234149 and U.S. Pat. No. 3,985,565 (Gabrielsen et al.) and the references cited above.

Sources of non-photosensitive reducible silver ions can also be core-shell silver salts as described in U.S. Pat. No. 6,355,408 (Whitcomb et al.) that is incorporated herein by reference, wherein a core has one or more silver salts and a shell has one or more different silver salts, as long as one of the silver salts is a silver carboxylate.

Other useful sources of non-photosensitive reducible silver ions are the silver dimer compounds that comprise two different silver salts as described in U.S. Pat. No. 6,472,131 (Whitcomb) that is incorporated herein by reference.

Still other useful sources of non-photosensitive reducible silver ions for photothermographic materials are the silver core-shell compounds comprising a primary core comprising one or more photosensitive silver halides, or one or more non-photosensitive inorganic metal salts or non-silver containing organic salts, and a shell at least partially covering the primary core, wherein the shell comprises one or more non-photosensitive silver salts, each of which silver salts comprises a organic silver coordinating ligand. Such compounds are described in U.S. Pat. No. 6,803,177 (Bokhonov et al.) that is incorporated herein by reference.

Organic silver salts that are particularly useful in organic solvent-based thermographic and photothermographic materials include silver carboxylates (both aliphatic and aromatic carboxylates), silver benzotriazolates, silver sulfonates, silver sulfosuccinates, and silver acetylides. Silver salts of long-chain aliphatic carboxylic acids containing 15 to 28 carbon atoms and silver salts of benzotriazoles are particularly preferred.

Organic silver salts that are particularly useful in aqueous based thermographic and photothermographic materials include silver salts of compounds containing an imino group. Preferred examples of these compounds include, but are not limited to, silver salts of benzotriazole and substituted derivatives thereof (for example, silver methylbenzotriazole and silver 5-chloro-benzotriazole), silver salts of 1,2,4-triazoles or 1-H-tetrazoles such as phenyl-mercaptotetrazole as described in U.S. Pat. No. 4,220,709 (deMauriac), and silver salts of imidazoles and imidazole derivatives as described in U.S. Pat. No. 4,260,677 (Winslow et al.). Particularly useful silver salts of this type are the silver salts of benzotriazole and substituted derivatives thereof. A silver salt of a benzotriazole is particularly preferred in aqueous-based thermographic and photo-thermographic formulations.

Useful nitrogen-containing organic silver salts and methods of preparing them are described in U.S. Pat. No. 6,977,39 (Zou et al.) that is incorporated herein by reference. Such silver salts (particularly the silver benzotriazoles) are rod-like in shape and have an average aspect ratio of at least 3:1 and a width index for particle diameter of 1.25 or less. Silver salt particle length is generally less than 1 μm. Also useful are the silver salt-toner co-precipitated nano-crystals comprising a silver salt of a nitrogen-containing heterocyclic compound containing an imino group, and a silver salt comprising a silver salt of a mercaptotriazole. Such co-precipitated salts are described in U.S. Pat. No. 7,008,748 (Hasberg et al.) Both of these patents are incorporated herein by reference.

The one or more non-photosensitive sources of reducible silver ions are preferably present in an amount of from about 5% to about 70%, and more preferably from about 10% to about 50%, based on the total dry weight of the emulsion layers. Alternatively stated, the amount of the sources of reducible silver ions is generally from about 0.001 to about 0.2 mol/m$^2$ of the dry photo-thermographic material (preferably from about 0.01 to about 0.05 mol/m$^2$).

The total amount of silver (from all silver sources) in the thermographic and photothermographic materials is generally at least 0.002 mol/m$^2$ and preferably from about 0.01 to about 0.05 mol/m$^2$.

Reducing Agents

The reducing agent (or reducing agent composition comprising two or more components) for the source of reducible silver ions can be any material (preferably an organic material) that can reduce silver(I) ion to metallic silver. The "reducing agent" is sometimes called a "developer" or "developing agent".

When a silver benzotriazole silver source is used, ascorbic acid reducing agents are preferred. An "ascorbic acid" reducing agent means ascorbic acid, complexes, and derivatives thereof. Ascorbic acid reducing agents are described in a considerable number of publications including U.S. Pat. No. 5,236,816 (Purol et al.) and references cited therein. Useful ascorbic acid reducing agents include ascorbic acid and the analogues, isomers and derivatives thereof. Such compounds include, but are not limited to, D- or L-ascorbic acid, sugar-type derivatives thereof (such as sorboascorbic acid, γ-lactoascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, potassium ascorbate, isoascorbic acid (or L-erythroascorbic acid), and salts thereof (such as alkali metal, ammonium, or others known in the art), endiol type ascorbic acid, an enaminol type ascorbic acid, a thioenol type ascorbic acid, and an enamin-thiol type ascorbic acid, as described in EP 0 573 700A1 (Lingier et al.), EP 0 585 792A1 (Passarella et al.), EP 0 588 408A1 (Hieronymus et al.), U.S. Pat. No. 2,688,549 (James et al.), U.S. Pat. No. 5,089,819 (Knapp), U.S. Pat. No. 5,278,035 (Knapp), U.S. Pat. No. 5,376,510 (Parker et al.), U.S. Pat. No. 5,384,232 (Bishop et al.), and U.S. Pat. No. 5,498,511 (Yamashita et al.), Japanese Kokai 7-56286 (Toyoda), and Research Disclosure, item 37152, March 1995. Mixtures of these reducing agents can be used if desired.

Additionally useful are the ascorbic acid reducing agents described in copending and commonly assigned U.S. Patent Application Publication 2005/0164136 (Ramsden et al.). Also useful are the solid particle dispersions of certain ascorbic acid esters that are prepared in the presence of a particle growth modifier that are described in U.S. Pat. No. 7,132,228 (Brick et al.) Both the above patent application publication and patent are incorporated herein by reference.

When a silver carboxylate silver source is used in a photothermographic material, one or more hindered phenol reducing agents are preferred. In some instances, the reducing agent composition comprises two or more components such as a hindered phenol developer and a co-developer that can be chosen from the various classes of co-developers and reducing agents described below. Ternary developer mixtures involving the further addition of contrast enhancing agents are also useful. Such contrast enhancing agents can be chosen from the various classes of reducing agents described below.

"Hindered phenol reducing agents" are compounds that contain only one hydroxy group on a given phenyl ring and have at least one additional substituent located ortho to the hydroxy group.

One type of hindered phenol includes hindered phenols and hindered naphthols. This type of hindered phenol includes, for example, 2,6-di-t-butyl-4-methylphenol, 2,6-di-t-butyl-4-benzylphenol 2-benzyl-4-methyl-6-t-butylphenol, and 2,4-dimethyl-6-(1'-methylcyclohexyl)phenol.

Another type of hindered phenol reducing agent are hindered bis-phenols. These compounds contain more than one hydroxy group each of which is located on a different phenyl ring. This type of hindered phenol includes, for example, binaphthols (that is dihydroxybinaphthyls), biphenols (that is dihydroxybiphenyls), bis(hydroxynaphthyl) methanes, bis(hydroxyphenyl)-methanes bis(hydroxyphenyl)ethers, bis(hydroxyphenyl)sulfones, and bis (hydroxyphenyl)thioethers, each of which may have additional substituents.

Preferred hindered phenol reducing agents are bis(hydroxyphenyl)-methanes such as, bis(2-hydroxy-3-t-butyl-5-methylphenyl)methane (CAO-5), 1,1'-bis(2-hydroxy-3,5-dimethylphenyl)-3,5,5-trimethylhexane (NONOX® or PERMANAX® WSO), and 1,1'-bis(2-hydroxy-3,5-dimethylphenyl)isobutane (LOWINOX® 221B46).

Mixtures of hindered phenol reducing agents can be used if desired, such as the mixture of a hindered phenol and a hindered bis-phenol described in U.S. Pat. No. 6,413,712 (Yoshioka et al.).

An additional class of reducing agents that can be used includes substituted hydrazines including the sulfonyl hydrazides described in U.S. Pat. No. 5,464,738 (Lynch et al.). Still other useful reducing agents are described in U.S. Pat. No. 3,074,809 (Owen), U.S. Pat. No. 3,094,417 (Workman), U.S. Pat. No. 3,080,254 (Grant, Jr.), U.S. Pat. No. 3,887,417 (Klein et al.), and U.S. Pat. No. 5,981,151 (Leenders et al.). All of these patents are incorporated herein by reference.

Additional reducing agents that may be used include amidoximes, azines, a combination of aliphatic carboxylic acid aryl hydrazides and ascorbic acid, a reductone and/or a hydrazine, piperidinohexose reductone or formyl-4-methylphenylhydrazine, hydroxamic acids, a combination of azines and sulfonamidophenols, α-cyanophenylacetic acid derivatives, reductones, indane-1,3-diones, chromans, 1,4-dihydropyridines, and 3-pyrazolidones.

Useful co-developer reducing agents can also be used as described in U.S. Pat. No. 6,387,605 (Lynch et al.). Additional classes of reducing agents that can be used as co-developers are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). Yet another class of co-developers includes substituted acrylonitrile compounds such as the compounds identified as HET-01 and HET-02 in U.S. Pat. No. 5,635,339 (Murray) and CN-01 through CN-13 in U.S. Pat. No. 5,545,515 (Murray et al.). All of the patents above are incorporated herein by reference.

Various contrast enhancing agents can be used in some photo-thermographic materials with specific co-developers. Examples of useful contrast enhancing agents include, but are not limited to, hydroxylamines, alkanolamines and ammonium phthalamate compounds as described in U.S. Pat. No. 5,545,505 (Simpson), hydroxamic acid compounds as described for example, in U.S. Pat. No. 5,545,507 (Simpson et al.), N-acylhydrazine compounds as described in U.S. Pat. No. 5,558,983 (Simpson et al.), and hydrogen atom donor compounds as described in U.S. Pat. No. 5,637,449 (Harring et al.). All of the patents above are incorporated herein by reference.

When used with a silver carboxylate silver source in a thermographic material, preferred reducing agents are aromatic di- and tri-hydroxy compounds having at least two hydroxy groups in ortho- or para-relationship on the same aromatic nucleus. Examples are hydroquinone and substituted hydroquinones, catechols, pyrogallol, gallic acid and gallic acid esters (for example, methyl gallate, ethyl gallate, propyl gallate), and tannic acid.

Particularly preferred are catechol-type reducing agents having no more than two hydroxy groups in an ortho-relationship.

One particularly preferred class of catechol-type reducing agents are benzene compounds in which the benzene nucleus is substituted by no more than two hydroxy groups which are present in 2,3-position on the nucleus and have in the 1-position of the nucleus a substituent linked to the nucleus by means of a carbonyl group. Compounds of this type include 2,3-dihydroxy-benzoic acid, and 2,3-dihydroxy-benzoic acid esters (such as methyl 2,3-dihydroxy-benzoate, and ethyl 2,3-dihydroxy-benzoate).

Another particularly preferred class of catechol-type reducing agents are benzene compounds in which the benzene nucleus is substituted by no more than two hydroxy groups which are present in 3,4-position on the nucleus and have in the 1-position of the nucleus a substituent linked to the nucleus by means of a carbonyl group. Compounds of this type include, for example, 3,4-dihydroxy-benzoic acid, 3-(3,4-dihydroxy-phenyl)-propionic acid, 3,4-dihydroxy-benzoic acid esters (such as methyl 3,4-dihydroxy-benzoate, and ethyl 3,4-dihydroxy-benzoate), 3,4-dihydroxy-benzaldehyde, and phenyl-(3,4-dihydroxyphenyl)ketone. 3,4-Dihydroxybenzonitrile is also useful. Such compounds are described, for example, in U.S. Pat. No. 5,582,953 (Uyttendaele et al.).

Still another useful class of reducing agents includes polyhydroxy spiro-bis-indane compounds described as photographic tanning agents in U.S. Pat. No. 3,440,049 (Moede).

Aromatic di- and tri-hydroxy reducing agents can also be used in combination with hindered phenol reducing agents and further in combination with one or more high contrast co-developing agents and co-developer contrast-enhancing agents).

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Co-developers may be present generally in an amount of from about 0.001% to about 1.5% (dry weight) of the emulsion layer coating.

Other Addenda

The thermally developable materials can also contain other additives such as shelf-life stabilizers, antifoggants, contrast enhancers, development accelerators, acutance dyes, post-processing stabilizers or stabilizer precursors, thermal solvents (also known as melt formers), and other image-modifying agents as would be readily apparent to one skilled in the art.

Suitable stabilizers that can be used alone or in combination include thiazolium salts as described in U.S. Pat. No. 2,131,038 (Brooker) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), compounds having —$SO_2CBr_3$ groups as described in U.S. Pat. No. 5,369,000 (Sakizadeh et al.), U.S. Pat. No. 5,464,747 (Sakizadeh et al.) U.S. Pat. No. 5,594,143 (Kirk et al.), U.S. Pat. No. 5,374,514 (Kirk et al.), and U.S. Pat. No. 5,460,938 (Kirk et al.).

Stabilizer precursor compounds capable of releasing stabilizers upon application of heat during imaging can also be used, as described in U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzo-triazoles may be used as stabilizing compounds as described in U.S. Pat. No. 6,171,767 (Kong et al.).

"Toners" or derivatives thereof that improve the image are desirable components of the thermally developable materials. These compounds, when added to the imaging layer, shift the color of the image from yellowish-orange to brown-black or blue-black. Generally, one or more toners described herein are present in an amount of from about 0.01% to about 10% (more preferably from about 0.1% to about 10%), based on the total dry weight of the layer in which the toner is included. Toners may be incorporated in the emulsion layer or in an adjacent non-imaging layer.

Compounds useful as toners are described in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (AGFA).

Additional useful toners are substituted and unsubstituted mercaptotriazoles as described in U.S. Pat. No. 3,832,186 (Masuda et al.), U.S. Pat. No. 6,165,704 (Miyake et al.), U.S. Pat. No. 5,149,620 (Simpson et al.), U.S. Pat. No. 6,713,240 (Lynch et al.), and U.S. Pat. No. 6,841,343 (Lynch et al.), all of which are incorporated herein by reference.

Phthalazine and phthalazine derivatives [such as those described in U.S. Pat. No. 6,146,822 (Asanuma et al.), incorporated herein by reference], phthalazinone, and phthalazinone derivatives are particularly useful toners.

A combination of one or more hydroxyphthalic acids and one or more phthalazinone compounds can be included in the thermally developable materials. Hydroxyphthalic acid compounds have a single hydroxy substituent that is in the meta position to at least one of the carboxy groups. Preferably, these compounds have a hydroxy group in the 4-position and carboxy groups in the 1- and 2-positions. The hydroxyphthalic acids can be further substituted in other positions of the benzene ring as long as the substituents do not adversely affect their intended effects in the thermally developable material. Mixtures of hydroxyphthalic acids can be used if desired.

Useful phthalazinone compounds are those having sufficient solubility to completely dissolve in the formulation from which they are coated. Preferred phthalazinone compounds include 6,7-dimethoxy-1-(2H)-phthalazinone, 4-(4-pentylphenyl)-1-(2H)-phthalazinone, and 4-(4-cyclohexylphenyl)-1-(2H)-phthalazinone. Mixtures of such phthalazinone compounds can be used if desired.

This combination facilitates obtaining a stable bluish-black image after processing. In preferred embodiments, the molar ratio of hydroxyphthalic acid to phthalazinone is sufficient to provide an a* value more negative than −2 (preferably more negative than −2.5) at an optical density of 1.2 as defined by the CIELAB Color System when the material has been imaged using a thermal print-head from 300 to 400° C. for less than 50 milliseconds (50 msec) and often less than 20 msec. In preferred embodiments, the molar ratio of phthalazinone is to hydroxyphthalic acid about 1:1 to about 3:1. More preferably the ratio is from about 2:1 to about 3:1.

In addition, the imaged material provides an image with an a* value more negative than −1 at an optical density of 1.2 as defined by the CIELAB Color System when the above imaged material is then stored at 70° C. and 30% RH for 3 hours.

Thermal solvents (or melt formers) can also be used, including combinations of such compounds (for example, a combination of succinimide and dimethylurea). Known thermal solvents are disclosed in U.S. Pat. No. 3,438,776 (Yudelson), U.S. Pat. No. 5,250,386 (Aono et al.), U.S. Pat. No. 5,368,979 (Freedman et al.). U.S. Pat. No. 5,716,772 (Taguchi et al.), and U.S. Pat. No. 6,013,420 (Windender).

The thermally developable materials can also include one or more image stabilizing compounds that are usually incorporated in a "backside" layer. Such compounds can include phthalazinone and its derivatives, pyridazine and its derivatives, benzoxazine and benzoxazine derivatives, benzothiazine-dione and its derivatives, and quinazoline-dione and its derivatives, particularly as described in U.S. Pat. No. 6,599,685 (Kong). Other useful backside image stabilizers include anthracene compounds, coumarin compounds, benzophenone compounds, benzotriazole compounds, naphthalic acid imide compounds, pyrazoline compounds, or compounds described in U.S. Pat. No. 6,465,162 (Kong et al.) and GB 1,565,043 (Fuji Photo).

The thermally developable materials may also include one or more additional polycarboxylic acids (other than the hydroxyphthalaic acids noted above) and/or anhydrides thereof that are in thermal working relationship with the sources of reducible silver ions in the one or more thermographic or photothermographic emulsion layers. Such polycarboxylic acids can be substituted or unsubstituted aliphatic (such as glutaric acid and adipic acid) or aromatic compounds and can be present in an amount of at least 5 mol % ratio to silver. They can be used in anhydride or partially esterified form as long as two free carboxylic acids remain in the molecule. Useful polycarboxylic acids are described for example in U.S. Pat. No. 6,096,486 (Emmers et al.).

The photothermographic materials can also include one or more image stabilizing compounds that are usually incorporated in a "backside" layer. Such compounds can include phthalazinone and its derivatives, pyridazine and its derivatives, benzoxazine and benzoxazine derivatives, benzothiazine dione and its derivatives, and quinazoline dione and its derivatives, particularly as described in U.S. Pat. No. 6,599, 685 (Kong). Other useful backside image stabilizers include anthracene compounds, coumarin compounds, benzophenone compounds, benzotriazole compounds, naphthalic acid imide compounds, pyrazoline compounds, or compounds described in U.S. Pat. No. 6,465,162 (Kong et al.), and GB 1,565,043 (Fuji Photo). All of these patents and patent applications are incorporated herein by reference.

Phosphors are materials that emit infrared, visible, or ultraviolet radiation upon excitation and can be incorporated into the photothermographic materials. Particularly useful phosphors are sensitive to X-radiation and emit radiation primarily in the ultraviolet, near-ultraviolet, or visible regions of the spectrum (that is, from about 100 to about 700 nm). An intrinsic phosphor is a material that is naturally (that is, intrinsically) phosphorescent. An "activated" phosphor is one composed of a basic material that may or may not be an intrinsic phosphor, to which one or more dopant(s) has been intentionally added. These dopants or activators "activate" the phosphor and cause it to emit ultraviolet or visible radiation. Multiple dopants may be used and thus the phosphor would include both "activators" and "co-activators".

Any conventional or useful phosphor can be used, singly or in mixtures. For example, useful phosphors are described in numerous references relating to fluorescent intensifying screens as well as U.S. Pat. No. 6,440,649 (Simpson et al.) and U.S. Pat. No. 6,573,033 (Simpson et al.) that are directed to photothermo-graphic materials. Some particularly useful phosphors are primarily "activated" phosphors known as phosphate phosphors and borate phosphors. Examples of these phosphors are rare earth phosphates, yttrium phosphates, strontium phosphates, or strontium fluoroborates (including cerium activated rare earth or yttrium phosphates, or europium activated strontium fluoroborates) as described in U.S. Pat. No. 7,074,549 (Simpson et al.) The above patents are incorporated herein by reference.

The one or more phosphors can be present in the photothermographic materials in an amount of at least 0.1 mole per mole, and preferably from about 0.5 to about 20 mole, per mole of total silver in the photothermographic material. As noted above, generally, the amount of total silver is at least 0.002 mol/m$^2$. While the phosphors can be incorporated into any imaging layer on one or both sides of the support, it is preferred that they be in the same layer(s) as the photosensitive silver halide(s) on one or both sides of the support.

Binders

The photosensitive silver halide (if present), the non-photosensitive source of reducible silver ions, the reducing agent composition, and any other imaging layer additives are generally combined with one or more binders that are generally hydrophobic or hydrophilic in nature. Thus, either aqueous or organic solvent-based formulations can be used to prepare the thermally developable materials of this invention. Mixtures of either or both types of binders can also be used. It is preferred that the binder be selected from predominantly hydrophobic polymeric materials (at least 50 dry weight % of total binders).

Examples of typical hydrophobic binders include polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral, polyvinyl acetal, and polyvinyl formal) and vinyl copolymers (such as polyvinyl acetate and polyvinyl chloride) are particularly preferred. Particularly suitable hydrophobic binders are polyvinyl butyral resins that are available under the names MOWITAL® (Kuraray America, New York, N.Y.), S-LEC® (Sekisui Chemical Company, Troy, Mich.), BUTVAR® (Solutia, Inc., St. Louis, Mo.) and PIOLOFORM® (Wacker Chemical Company, Adrian, Mich.).

Hydrophilic binders or water-dispersible polymeric latex polymers can also be present in the formulations. Examples of useful hydrophilic binders include, but are not limited to, proteins and protein derivatives, gelatin and gelatin-like derivatives (hardened or unhardened), cellulosic materials such as hydroxymethyl cellulose and cellulosic esters, acrylamide/methacrylamide polymers, acrylic/methacrylic polymers polyvinyl pyrrolidones, polyvinyl alcohols, poly(vinyl lactams), polymers of sulfoalkyl acrylate or methacrylates, hydrolyzed polyvinyl acetates, polyacrylamides, polysaccharides and other synthetic or naturally occurring vehicles commonly known for use in aqueous-based photographic emulsions (see for example, *Research Disclosure,* item 38957, noted above). Cationic starches can also be used as a peptizer for tabular silver halide grains as described in U.S. Pat. No. 5,620,840 (Maskasky) and U.S. Pat. No. 5,667,955 (Maskasky).

Hardeners for various binders may be present if desired. Useful hardeners are well known and include diisocyanate compounds as described in EP 0 600 586 B1 (Philip, Jr. et al.), vinyl sulfone compounds as described in U.S. Pat. No. 6,143,487 (Philip, Jr. et al.) and EP 0 640 589 A1 (Gathmann et al.), aldehydes and various other hardeners as described in U.S. Pat. No. 6,190,822 (Dickerson et al.). The hydrophilic binders used in the photothermographic materials are generally partially or fully hardened using any conventional hardener. Useful hardeners are well known and are described, for example, in T. H. James, *The Theory of the Photographic Process,* Fourth Edition, Eastman Kodak Company, Rochester, N.Y., 1977, Chapter 2, pp. 77-8.

Where the proportions and activities of the thermally developable materials require a particular developing time and temperature, the binder(s) should be able to withstand those conditions. When a hydrophobic binder is used, it is preferred that the binder (or mixture thereof) does not decompose or lose its structural integrity at 120° C. for 60 seconds. When a hydrophilic binder is used, it is preferred that the binder does not decompose or lose its structural integrity at 150° C. for 60 seconds. It is more preferred that the binder not decompose or lose its structural integrity at 177° C. for 60 seconds.

The polymer binder(s) is used in an amount sufficient to carry the components dispersed therein. Preferably, a binder is used at a level of from about 10% to about 90% by weight (more preferably at a level of from about 20% to about 70% by weight) based on the total dry weight of the layer. It is particularly useful that the thermally developable materials include at least 50 weight % hydrophobic binders in both imaging and non-imaging layers on both sides of the support (and particularly the imaging side of the support).

Support Materials

The thermally developable materials comprise a polymeric support that is preferably a flexible, transparent film that has any desired thickness and is composed of one or more polymeric materials. They are required to exhibit dimensional stability during thermal development and to have suitable adhesive properties with overlying layers.

Useful polymeric materials for making such supports include polyesters [such as poly(ethylene terephthalate) and poly(ethylene naphthalate)], cellulose acetate and other cellulose esters, polyvinyl acetal, polyolefins, polycarbonates, and polystyrenes. Preferred supports are composed of polymers having good heat stability, such as polyesters and polycarbonates. Support materials may also be treated or annealed to reduce shrinkage and promote dimensional stability.

It is also useful to use transparent, multilayer, polymeric supports comprising numerous alternating layers of at least two different polymeric materials as described in U.S. Pat. No. 6,630,283 (Simpson et al.). Another support comprises dichroic mirror layers as described in U.S. Pat. No. 5,795,708 (Boutet). Both of the above patents are incorporated herein by reference.

Opaque supports can also be used, such as dyed polymeric films and resin-coated papers that are stable to high temperatures.

Support materials can contain various colorants, pigments, antihalation or acutance dyes if desired. For example, the support can include one or more dyes that provide a blue color in the resulting imaged film. Support materials may be treated using conventional procedures (such as corona discharge) to improve adhesion of overlying layers, or subbing or other adhesion-promoting layers can be used.

Thermographic and Photothermographic Formulations and Constructions

An organic solvent-based coating formulation for the thermographic and photothermographic emulsion layer(s) can be prepared by mixing the various components with one or more binders in a suitable organic solvent system that usually includes one or more solvents such as toluene, 2-butanone (methyl ethyl ketone), acetone, or tetrahydrofuran, or mixtures thereof. Methy ethyl ketone is a preferred coating solvent.

Alternatively, the desired imaging components can be formulated with a hydrophilic binder (such as gelatin, a gelatin-derivative, or a latex) in water or water-organic solvent mixtures to provide aqueous-based coating formulations.

Thermally developable materials can contain plasticizers and lubricants such as poly(alcohols) and diols as described in U.S. Pat. No. 2,960,404 (Milton et al.), fatty acids or esters as described in U.S. Pat. No. 2,588,765 (Robijns) and U.S. Pat. No. 3,121,060 (Duane), and silicone resins as described in GB 955,061 (DuPont). The materials can also contain inorganic and organic matting agents as described in U.S. Pat. No. 2,992,101 (Jelley et al.) and U.S. Pat. No. 2,701,245 (Lynn). Polymeric fluorinated surfactants may also be useful in one or more layers as described in U.S. Pat. No. 5,468,603 (Kub).

U.S. Pat. No. 6,436,616 (Geisler et al.), incorporated herein by reference, describes various means of modifying photothermographic materials to reduce what is known as the "woodgrain" effect, or uneven optical density.

Layers to promote adhesion of one layer to another are also known, as described in U.S. Pat. No. 4,741,992 (Przezdziecki), U.S. Pat. No. 5,804,365 (Bauer et al.), and U.S. Pat. No. 5,891,610 (Bauer et al.). Adhesion can also be promoted using specific polymeric adhesive materials as described in U.S. Pat. No. 5,928,857 (Geisler et al.).

Layers to reduce emissions from the material may also be present, including the polymeric barrier layers described in U.S. Pat. No. 6,352,819 (Kenney et al.), U.S. Pat. No. 6,352,820 (Bauer et al.), U.S. Pat. No. 6,420,102 (Bauer et al.), U.S. Pat. No. 6,667,148 (Rao et al.), and U.S. Pat. No. 6,746,831 (Hunt), all incorporated herein by reference.

Mottle and other surface anomalies can be reduced by incorporation of a fluorinated polymer as described in U.S. Pat. No. 5,532,121 (Yonkoski et al.) or by using particular drying techniques as described, for example in U.S. Pat. No. 5,621,983 (Ludemann et al.).

The thermally developable materials can also include one or more antistatic or conductive layers on the frontside of the support. Such layers may contain metal oxides as described below, or other conventional antistatic agents known in the art for this purpose such as soluble salts (for example, chlorides or nitrates), evaporated metal layers, or ionic or conductive polymers such as those described in U.S. Pat. No. 2,861,056 (Minsk) and U.S. Pat. No. 3,206,312 (Sterman et al.), comductive polythiophenes such as those described in U.S. Pat. No. 5,747,412 (Leenders et al.), or insoluble inorganic salts such as those described in U.S. Pat. No. 3,428,451 (Trevoy), electroconductive underlayers such as those described in U.S. Pat. No. 5,310,640 (Markin et al.), electronically-conductive metal antimonate particles such as those described below and in U.S. Pat. No. 5,368,995 (Christian et al.), electrically-conductive metal-containing particles dispersed in a polymeric binder such as those described in EP 0 678 776A1 (Melpolder et al.), and fluorochemicals that are described in numerous publications.

The photothermographic and thermographic materials may also usefully include a magnetic recording material as described in *Research Disclosure,* Item 34390, November 1992, or a transparent magnetic recording layer such as a layer containing magnetic particles on the underside of a transparent support as described in U.S. Pat. No. 4,302,523 (Audran et al.).

To promote image sharpness, photothermographic materials can contain one or more layers containing acutance and/or antihalation dyes. These dyes are chosen to have absorption close to the exposure wavelength and are designed to absorb scattered light. One or more antihalation compositions may be incorporated into the support, backside layers, underlayers, or overcoats. Additionally, one or more acutance dyes may be incorporated into one or more frontside imaging layers.

Dyes useful as antihalation and acutance dyes include squaraine dyes as described in U.S. Pat. No. 5,380,635 (Gomez et al.) and U.S. Pat. No. 6,063,560 (Suzuki et al.), and EP 1 083 459A1 (Kimura), indolenine dyes as described in EP 0 342 810A1 (Leichter), and cyanine dyes as described in U.S. Pat. No. 6,689,547 (Hunt et al.), all incorporated herein by reference.

It is also useful to employ compositions including acutance or antihalation dyes that will decolorize or bleach with heat during processing, as described in U.S. Pat. No. 5,135,842 (Kitchin et al.), U.S. Pat. No. 5,266,452 (Kitchin et al.), U.S. Pat. No. 5,314,795 (Helland et al.), and U.S. Pat. No. 6,306,566, (Sakurada et al.), Japanese Kokai 2001-142175 (Hanyu et al.) and 2001-183770 (Hanye et al.). Useful bleaching compositions are also described in Japanese Kokai 11-302550 (Fujiwara), 2001-109101 (Adachi), 2001-51371 (Yabuki et al.), and 2000-029168 (Noro). All of the noted publications are incorporated herein by reference.

Other useful heat-bleachable antihalation compositions can include an infrared radiation absorbing compound such as an oxonol dye or various other compounds used in combination with a hexaarylbiimidazole (also known as a "HABI"), or mixtures thereof. HABI compounds are described in U.S. Pat. No. 4,196,002 (Levinson et al.), U.S. Pat. No. 5,652,091 (Perry et al.), and U.S. Pat. No. 5,672,562

(Perry et al.), all incorporated herein by reference. Examples of such heat-bleachable compositions are described in U.S. Pat. No. 6,455,210 (Irving et al.), U.S. Pat. No. 6,514,677 (Ramsden et al.), and U.S. Pat. No. 6,558,880 (Goswami et al.), all incorporated herein by reference.

The thermally developable material can have an optical density of from about 0.2 to about 3.5 on the imaging layer side of the support or an optical density of up to 2 on the backside of the support by the incorporation of the appropriate components such as acutance, antihalation, and filter dyes.

Under practical conditions of use, these compositions are heated to provide bleaching at a temperature of at least 90° C. for at least 0.5 seconds (preferably, at a temperature of from about 100° C. to about 200° C. for from about 5 to about 20 seconds).

In some embodiments, the thermally developable materials include a surface protective layer over one or more imaging layers on one or both sides of the support. In other embodiments, the materials include a surface protective layer on the same side of the support as the one or more emulsion layers and a layer on the backside that includes the required conductive composition (with or without an antihalation composition or layer). A separate non-conductive, backside surface protective layer can also be included in these embodiments.

The thermally developable formulations can be coated by various coating procedures including wire wound rod coating, dip coating, air knife coating, curtain coating, slide coating, slot-die coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4.569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), and U.S. Pat. No. 5,861,195 (Bhave et al.), and GB 837,095 (Ilford). A typical coating gap for the emulsion layer can be from about 10 to about 750 μm, and the layer can be dried in forced air at a temperature of from about 20° C. to about 100° C. it is preferred that the thickness of the layer be selected to provide maximum image densities greater than about 0.2, and more preferably, from about 0.5 to 5.0 or more, as measured by an X-rite Model 361/V Densitometer equipped with 301 Visual Optics, available from X-rite Corporation, (Granville, Mich.).

Subsequently to or simultaneously with application of the emulsion formulation to the support, a protective overcoat formulation can be applied over the emulsion formulation.

Preferably, two or more layer formulations are applied simultaneously to a support using slide coating, the first layer being coated on top of the undercoat layer while the undercoat layer is still wet. The first and second fluids used to coat these layers can be the same or different solvents. Simultaneous coating can be used to apply layers on the frontside, backside, or both sides of the support.

In other embodiments, a "carrier" layer formulation comprising a single-phase mixture of two or more polymers may be applied directly onto the support and thereby located underneath the emulsion layer(s) as described in U.S. Pat. No. 6,355,405 (Ludemann et al.), incorporated herein by reference. The carrier layer formulation can be applied simultaneously with application of the emulsion layer formulation and any additional frontside overcoat formulations.

Backside Compositions/Layers

The thermally developable materials have at least one outermost layer on the backside (non-imaging side) of the support that includes at least 0.0004 mol/m$^2$ of one or more quaternary ammonium salts. These salts have a molecular weight of less than 650 (preferably from about 180 to about 470 and more preferably from about 235 to about 470) and comprise four aliphatic organic groups attached to the quaternary ammonium cation provided that at least one aliphatic organic group has 6 to 20 carbon atoms and at least two aliphatic organic groups are the same or different aliphatic groups having 1 to 5 carbon atoms.

More particularly, the quaternary ammonium salts can be represented by the following Structure (I):

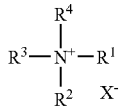

(I)

wherein at least one of $R^1$, $R^2$, $R^3$, and $R^4$ is an independently substituted or unsubstituted aliphatic group having 6 to 20 carbon atoms, or mixtures thereof, and at least two of $R^1$, $R^2$, $R^3$, and $R^4$ are independently substituted or unsubstituted aliphatic groups having 1 to 5 carbon atoms, and $X^-$ is a monovalent anion.

The aliphatic groups can be alkyl groups, cycloalkyl groups, or a combination of such groups, and they can have one or more heteroatom linking groups, such as oxy, thio, or amino groups, within the aliphatic chain. Substituents on the "R" groups can be any group that will not adversely affect the performance of the quaternary ammonium salt.

Preferably, at least one of $R^1$, $R^2$, $R^3$, and $R^4$ is a substituted or unsubstituted alkyl group having 10 to 20 carbon atoms, and at least two of $R^1$, $R^2$, $R^3$, and $R^4$ are independently substituted or unsubstituted alkyl groups having 1 to 5 carbon atoms, and $X^-$ is chloride. When two of $R^1$, $R^2$, $R^3$, and $R^4$ are a substituted or unsubstituted alkyl group having 10 to 20 carbon atoms, the two groups may be the same or different. Similarly, the two or more of $R^1$, $R^2$, $R^3$, and $R^4$ groups having 1 to 5 carbon atoms may be the same or different. Most preferably, $R^1$ is an unsubstituted alkyl group having 10 to 20 carbon atoms, $R^2$, $R^3$, and $R^4$ are independently methyl or hydroxyethyl, and $X^-$ is chloride.

It is also possible for one or more of $R^1$, $R^2$, $R^3$, and $R^4$ to include additional quaternary ammonium groups. Such compounds are referred to as "gemini surfactants" and are composed of aliphatic groups attached to an amino group attached to an alkylene chain connected to another amino group that is attached to aliphatic groups. Such compounds would then have sufficient $X^-$ anions, of the same or different type, to provide a net neutral charge in the molecule.

Additionally, two of the "R" groups can be combined to form a quaternary ammonium salt incorporating a nitrogen-containing alicyclic ring such as a pyrrolidine, morpholine, piperidine, or piperazine ring as long as at least one of the remaining "R" groups comprise at least one $C_6$ to $C_{20}$ aliphatic group.

$X^-$ is a monovalent anion. Useful anions include halides (such as iodide, bromide, and chloride), acetate, and nitrate.

Chloride is preferred.

Representative quaternary ammonium salts include the following compounds:

Decyltrimethylammonium chloride,

Dodecyltrimethylammonium chloride (ARQUAD® 12-50),

Tetradecyltrimethylammonium chloride,

Octadecyltrimethylammonium chloride,

N,N-Bis(2-hydroxy ethyl)-N-methyl-9-octadecenyl-1-ammonium chloride,

Hexyltrimethylammonium bromide,

Octyltrimethylammonium bromide,

Tetradecyltrimethylammonium bromide,

N,N,N',N',N'-pentamethyl-N-tallow-1,3-propane diammonium dichloride (DUOQUAD® T50)

Di(hydrogenated tallowalkyl)dimethylammonium chloride (ARQUAD® 2HT-75),

Tris(2-hydroxyethyl)tallowalkyl ammonium acetate (ETHOQUAD® t13-27W), and

Cocoalkylmethylbis(2-hydroxyethyl)ammonium chloride (ETHOQUAD® C/12-75).

Decyltrimethylammonium chloride, dodecyltrimethyl ammonium chloride, tetradecyltrimethylammonium chloride, octadecyltrimethylammonium chloride, and N,N,N',N',N'-pentamethyl-N-tallow-1,3-propane diammonium dichloride are preferred compounds for the present invention.

The quaternary ammonium salts can generally be obtained from a number of commercial sources including Akzo Nobel Surface Chemistry LLC and Aldrich Chemical Company.

The one or more quaternary ammonium compounds are present in one or more backside layers in a total amount of from about 0.0004 to about 0.0025 mol/$m^2$. Preferably, they are present in a single outermost backside layer in an amount of from about 0.0055 to about 0.001 mol/$m^2$. Generally, the quaternary ammonium salts are present in sufficient amount(s) to provide a backside water electrode resistivity (WER) of$1\times10^{12}$ ohm/sq (log resistivity 12 ohm/sq) or less and preferably$1\times10^{11}$ ohm/sq (log resistivity 11 ohm/sq) or less at 70° F. (21.1° C.) and 50% relative humidity.

The one or more quaternary ammonium salts are dispersed in one or more film-forming binders. Useful binders are defined above in the "Binders" section and more specific binders and binder combinations are described below in relation to the "carrier" and protective layers. Preferably, the binder(s) are hydrophobic polymers that are coated out of organic solvents (described above) and include, but are not limited to, polyvinyl butyral, polyesters, cellulose acetate, cellulose acetate propionate, and cellulose acetate butyrate.

In some embodiments, there is only one backside layer and this layer contains the quaternary ammonium salt, with or without additional conductive materials such as metal oxides (defined below). Preferably, the quaternary ammonium salt is the sole antistatic material or conductive agent on the backside of the support.

In other embodiments, the quaternary ammonium salts are present only in an outermost first backside layer coated above a buried backside conductive layer. It is preferred that the buried backside conductive layer contain particles of a conductive metal oxide or a conductive polymer. In this construction, it is more preferred that the buried backside conductive layer be a "carrier" layer. This combination permits the use of a lower amount of conductive metal oxide without loss in conductive properties.

Useful conductive polymers include polythiophenes, polypyrroles, and polyanilines that are described in many publications including U.S. Pat. No. 5,093,439 (Jiang et al.), U.S. Pat. No. 5,300,575 (Friedrich et al.), U.S. Pat. No. 5,575,898 (Gerhard-Dieter et al.), U.S. Pat. No. 5,665,498 (Savage et al.), U.S. Pat. No. 5,674,654 (Zumbulyadis et al.), and U.S. Pat. No. 5,716,550 (Gardner et al.).

Useful conductive metal particles include conductive nanoparticles of $TiO_2$, $SnO_2$, $Al_2O_3$, $ZrO_2$, $In_2O_3$, ZnO, $TiB_2$, $ZrB_2$, $NbB_2$, $TaB_2$, $CrB_2$, MoB, WB, $LaB_6$, ZrN, TiN, TiC, WC, HfC, HfN, ZrC, acicular and non-acicular zinc antimonate ($ZnSb_2O_6$), indium-doped tin oxide, antimony-doped tin oxide, aluminum-doped zinc oxide, tungsten trioxide, vanadium pentoxide, molybdenum trioxide, and niobium-doped titanium oxide. Conductive nanoparticles of non-acicular metal antimonates are more preferred.

Such conductive metal antimonate particles generally have a composition represented by the following Structure II or III:

$$M^{+2}Sb^{+5}{}_2O_6 \quad \text{(II)}$$

wherein M is zinc, nickel, magnesium, iron, copper, manganese, or cobalt, $$Ma+3Sb+5O4 \quad \text{(III)}$$

wherein $M_a$ is indium, aluminum, scandium, chromium, iron, or gallium.

Thus, these particles are generally metal oxides that are doped with antimony.

Preferably, the non-acicular metal antimonate particles are composed of zinc antimonate ($ZnSb_2O_6$). Several conductive metal antimonates are commercially available from Nissan Chemical America Corporation including the preferred non-acicular zinc antimonate ($ZnSb_2O_6$) particles that are available as a 60% (solids) organosol dispersion in methanol under the tradename CELNAX® CX-Z641M.

Alternatively, the metal antimonate particles can be prepared using methods described for example in U.S. Pat. No. 5,457,013 (Christian et al.) and references cited therein.

The metal antimonate particles are predominately in the form of non-acicular particles as opposed to "acicular" particles. By "non-acicular" particles is meant not needle-like, that is, not acicular. Thus, the shape of the metal antimonate particles can be granular, spherical, ovoid, cubic, rhombic, tabular, tetrahedral, octahedral, icosahedral, truncated cubic, truncated rhombic, or any other non-needle like shape. Generally, these metal particles have an average diameter of from about 15 to about 20 nm as measured across the largest particle dimension using the BET method.

The non-acicular metal antimonate particles are generally present in an amount sufficient to provide the backside antistatic construction a backside water electrode resistivity (WER) of log resistivity 12 ohm/sq or less and preferably a log resistivity of 11 ohm/sq or less at 70° F. (21.1° C.) and 50% relative humidity.

The non-acicular metal antimonate particles generally comprise from about more than 55 and up to 85% (preferably from 60 to about 76% and more preferably from about 70 to about 76%) by weight of the dry backside layer. Another way of defining the amount of particles is that they are generally present in the backside layer in an amount of from about 0.06 to about 0.5 g/$m^2$ (preferably from about 0.06 to about 0.4 g/$m^2$ and more preferably from about 0.06 to about 0.2 g/$m^2$) of the dry layer coverage. Mixtures of different types of non-acicular metal antimonate particles can be used if desired.

The buried backside layer includes one or more binders (described in detail below) in an amount to provide a total binder to conductive particle ratio of less than 0.75:1 and preferably of from about 0.4:1 to about 0.3:1, based on dry weight. The optimum ratio of total binder to conductive particles can vary depending upon the specific binders used, the conductive particle size, the coverage of conductive particles, and the dry thickness of the conductive layer. One skilled in the art would be able to determine the optimum parameters to achieve the desired conductivity and adhesion to adjacent layers and/or support.

Preferably, the conductive metal antimonate particles are present in one or more buried backside layers. In such embodiments, the relationship of the buried backside layer(s), and the layer or layers immediately adjacent is important because the types of polymers and binders in these layers are designed to provide adequate adhesion to one another as well as acceptably dispersing the conductive metal antimonate particles and/or or layer components, and are readily coated simultaneously or separately. In these embodiments, the quaternary ammonium salt(s) is present in a layer disposed over the buried layers such as an outermost protective layer.

The buried backside conductive layer may also be relatively thin, especially if it is a buried conductive layer. For example, it can have a dry thickness of from about 0.05 to about 0.65 μm (preferably from 0.09 to about 0.3 μm, and most preferably of from about 0.09 to about 0.2 μm). The thin buried backside conductive layers are useful as "carrier" layers. The term "carrier layer" is often used when multiple layers are coated using slide coating and the buried backside conductive layer is a thin layer adjacent to the support.

In one preferred embodiment, the buried backside conductive layer is a carrier layer and is directly disposed on the support without the use of primer or subbing layers, or other adhesion-promoting means such as support surface treatments. Thus, the support can be used in an "untreated" and "uncoated" form when a buried backside conductive layer is used. The carrier layer formulation is applied simultaneously with application of these other backside layer formulations and is thereby located underneath these other backside layers. In a preferred construction, the backside conductive, carrier layer formulation comprises a single-phase mixture of the two or more polymers described above and non-acicular metal antimonate particles.

The layer directly disposed over the buried backside layer is known herein as a "first" layer and can be known as a "protective" layer that can be the outermost topcoat layer or have further layer(s) disposed thereon. This first layer comprises a film-forming polymer. The buried backside conductive layer immediately underneath comprises the non-acicular metal antimonate particles in a mixture of two or more polymers that includes a "first" polymer serving to promote adhesion of the buried backside conductive layer directly to the polymeric support, and a "second" polymer that is different than and forms a single-phase mixture with the first polymer.

It is preferred that film-forming polymer of the first layer and the second polymer of the buried backside conductive layer are the same or different polyvinyl acetal resins, polyester resins, cellulosic polymers, maleic anhydride-ester copolymers, or vinyl polymers. It is more preferred that the film-forming polymer of the first layer and the second polymer of the buried backside conductive layer is a polyvinyl acetal such as polyvinyl butyral or cellulose ester such as cellulose acetate butyrate. It is preferred that the "first" polymer of the buried backside conductive layer is a polyester resin. It is most preferred that the buried backside conductive layer is a single phase mixture of a polyester resin as a "first" polymer and cellulose acetate butyrate as a "second" polymer".

It is preferred to use a mixture of polymers, that is, a first polymer that promotes adhesion to the support and a second polymer that promotes adhesion to the first layer. For example, when the support is a polyester film, and the buried backside conductive layer contains a polyvinyl acetal or a cellulose ester, then a preferred mixture of polymers in that conductive layer is a single-phase mixture of a polyester resin and a polyvinyl acetal such as polyvinyl butyral or cellulose ester such as cellulose acetate butyrate.

In another embodiment, the buried backside conductive layer is disposed between a "first" layer and a "second" layer directly adhering the support. In this embodiment, the "first" layer is directly above the backside conductive layer and is known herein as a "first" layer, a "protective" layer, or a "protective topcoat" layer. It can be the outermost topcoat layer or have further layer(s) disposed thereon. This first layer comprises a film-forming polymer and the quaternary ammonium salt. The buried backside conductive layer immediately beneath the first layer comprises the non-acicular metal antimonate particles in a polymer that serves to promote adhesion of the backside conductive layer to the first layer as well as to a "second" layer immediately beneath it. This second layer is directly adhered to the polymeric support. The second layer directly adhered to the support comprises a mixture of two or more polymers. The first polymer serves to promote adhesion of the second layer directly to the polymeric support. The second polymer serves to promote adhesion of the second layer to the buried backside conductive layer.

It is preferred that the film-forming polymer of the first layer, the polymer of the buried backside conductive layer, and the second polymer of the second layer are the same or different polyvinyl acetal resins, polyester resins, cellulosic ester polymers, maleic anhydride-ester copolymers, or vinyl polymers. A preferred polymer is cellulose acetate butyrate.

It is preferred that the second layer also includes a single phase mixture of a polyester resin as a "first" polymer and a polyvinyl acetal such as polyvinyl butyral or cellulose ester such as cellulose acetate butyrate as a "second" polymer".

Representative "first" polymers can be chosen from one or more of the following classes: polyvinyl acetals (such as polyvinyl butyral, polyvinyl acetal, and polyvinyl formal), cellulosic ester polymers (such as cellulose acetate, cellulose diacetate, cellulose triacetate, cellulose acetate propionate, hydroxy-methyl cellulose, cellulose nitrate, and cellulose acetate butyrate), polyesters, polycarbonates, epoxies, rosin polymers, polyketone resin, vinyl polymers (such as polyvinyl chloride, polyvinyl acetate, polystyrene, polyacrylonitrile, and butadiene-styrene copolymers), acrylate and methacrylate polymers, and maleic anhydride ester copolymers. The polyvinyl acetals, polyesters, cellulosic ester polymers, and vinyl polymers such as polyvinyl acetate and polyvinyl chloride are particularly preferred, and the polyvinyl acetals, polyesters, and cellulosic ester polymers are more preferred. Polyester resins are most preferred. Thus, the adhesion-promoting polymers are generally hydrophobic in nature.

Representative "second" polymers include polyvinyl acetals, cellulosic polymers, vinyl polymers (as defined above for the "first" polymer), acrylate and methacrylate polymers, and maleic anhydride-ester copolymers. The most preferred "second" polymers are polyvinyl acetals and cellulosic ester polymers (such as cellulose acetate, cellulose diacetate, cellulose triacetate, cellulose acetate propionate, hydroxymethyl cellulose, cellulose nitrate, and cellulose acetate butyrate). Cellulose acetate butyrate is a particularly preferred second polymer. Of course, mixtures of these second polymers can be used in the buried backside conductive layer. These second polymers are also soluble or dispersible in the organic solvents described above.

It is preferred that the "first" and "second" polymers are compatible with each other or are of the same polymer class. One skilled in the art would readily understand from the teaching herein which polymers are "compatible with" or "of the same class" as those film-forming polymers. For example, it is most preferred to use a single phase mixture of a polyester resin as a "first" polymer and a cellulose ester such as cellulose acetate butyrate as a "second" polymer".

The weight ratio of "first" polymer to "second" polymer in the backside conductive layer is generally from about 10:90 to about 50:50, and preferably from about 20:80 to about 40:60. A most preferred polymer combination is of polyester and cellulose acetate butyrate having a weight ratio of about 40:60.

The backside layers are generally coated out of one or more miscible organic solvents including, but not limited to, methyl ethyl ketone(2-butanone, MEK), acetone, toluene, tetrahydrofuran, ethyl acetate, ethanol, methanol, or any mixture of any two or more of these solvents.

The backside layers can also include still other polymers that are not defined herein as first or second polymers. These additional polymers can be either hydrophobic or hydrophilic. Some hydrophilic polymers that may be present include, but are not limited to, proteins or polypeptides such as gelatin and gelatin derivatives, polysaccharides, gum arabic, dextrans, polyacrylamides (including polymethacrylamides), polyvinyl pyrrolidones and others that would be readily apparent to one skilled in the art.

Other components of the backside layers include materials that may improve coatability or adhesion, crosslinking agents (such as diisocyanates), shelf-aging promoters, antihalation dyes (usually in the outermost layer), colorants to control tint and tone, magnetic recording materials to record data, UV absorbing materials to improve light-box stability, and coating aids such as surfactants to achieve high quality coatings, all in conventional amounts. It is also useful to add inorganic matting agents such as the silica or polysilicic acid particles as described in U.S. Pat. No. 4,828,971 (Przezdziecki), poly(methyl methacrylate)beads as described in U.S. Pat. No. 5,310,640 (Markin et al.), or polymeric cores surrounded by a layer of colloidal inorganic particles as described in U.S. Pat. No. 5,750,328 (Melpolder et al.) especially in the outermost backside layer.

In one preferred embodiment, the "first" backside layer (usually referred to as a protective or topcoat layer) includes an antihalation composition, such as those antihalation compositions described above, in addition to the one or more quaternary ammonium salts described herein.

Imaging/Development

The thermally developable materials can be imaged in any suitable manner consistent with the type of material using any suitable imaging source (typically some type of radiation or electronic signal for photothermographic materials and a source of thermal energy for thermographic materials). In some embodiments, the materials are sensitive to radiation in the range of from about at least 100 nm to about 1400 nm, and normally from about 300 nm to about 850 nm (preferably from about 300 to about 600 nm, more preferably from about 300 to about 450 nm, even more preferably from about 360 to about 420 nm, and most preferably from about 380 to about 420 nm). In other embodiments, the materials are sensitive to radiation at 700 nm or greater (such as from about 750 to about 950 nm). If necessary, sensitivity to a particular wavelength can be achieved by using appropriate spectral sensitizing dyes.

Imaging can be achieved by exposing the photothermographic materials to a suitable source of radiation to which they are sensitive, including X-radiation, ultraviolet radiation, visible light, near infrared radiation and infrared radiation to provide a latent image. Suitable exposure means are well known and include phosphor emitted radiation (particularly X-ray induced phosphor emitted radiation), incandescent or fluorescent lamps, xenon flash lamps, lasers, laser diodes, light emitting diodes, infrared lasers, infrared laser diodes, infrared light-emitting diodes, infrared lamps, or any other ultraviolet, visible, or infrared radiation source readily apparent to one skilled in the art, such as described in *Research Disclosure,* September, 1996, item 38957. Particularly useful infrared exposure means include laser diodes, including laser diodes that are modulated to increase imaging efficiency using what is known as multi-longitudinal exposure techniques as described in U.S. Pat. No. 5,780,207 (Mohapatra et al.). Other exposure techniques are described in U.S. Pat. No. 5,493,327 (McCallum et al.).

The photothermographic materials also can be indirectly imaged using an X-radiation imaging source and one or more prompt-emitting or storage X-radiation sensitive phosphor screens adjacent to the photothermographic material. The phosphors emit suitable radiation to expose the photothermographic material. Preferred X-ray screens are those having phosphors emitting in the near ultraviolet region of the spectrum (from 300 to 400 nm), in the blue region of the spectrum (from 400 to 500 nm), and in the green region of the spectrum (from 500 to 600 nm).

In other embodiments, the photothermographic materials can be imaged directly using an X-radiation imaging source to provide a latent image.

Thermal development conditions will vary, depending on the construction used but will typically involve heating the imagewise exposed material at a suitably elevated temperature, for example, from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means. A preferred heat development procedure for photothermographic materials includes heating at from 130° C. to about 165° C. for from about 3 to about 25 seconds. Thermal development is carried out with a photothermographic material in a substantially water-free environment and without application of any solvent to the material.

When imaging thermographic materials, the image may be "written" simultaneously with development at a suitable temperature using a thermal stylus, a thermal print-head or a laser, or by heating while in contact with a heat-absorbing material. The thermographic materials may include a dye (such as an IR-absorbing dye) to facilitate direct development by exposure to laser radiation.

Thermal developable of the thermally processable materials is carried out with the material being in a substantially water-free environment and without application of any solvent to the material.

Use as a Photomask

The thermographic and photothermographic materials can be sufficiently transmissive in the range of from about 350 to about 450 nm in non-imaged areas to allow their use in a method where there is a subsequent exposure of an ultraviolet or short wavelength visible radiation sensitive imageable medium. The heat-developed materials absorb ultraviolet or short wavelength visible radiation in the areas where there is a visible image and transmit ultraviolet or short wavelength visible radiation where there is no visible image. The heat-developed materials may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed thermographic or photothermographic material provides an image in the imageable material. This method is particularly useful where the imageable medium comprises a printing plate and the photothermographic material serves as an imagesetting film.

Thus, in some other embodiments wherein the thermographic or photothermographic material comprises a transparent support, the image-forming method further comprises, after steps (A) and (B) or step (A') noted above:

(C) positioning the exposed and heat-developed photothermographic material between a source of imaging radiation and an imageable material that is sensitive to the imaging radiation, and (D) thereafter exposing the imageable material to the imaging radiation through the visible image in the exposed and heat-developed photothermographic material to provide an image in the imageable material.

The transparent imaged thermographic materials can be similarly used as photomasks.

The following examples are provided to illustrate the practice of the present invention and the invention is not meant to be limited thereby.

MATERIALS AND METHODS FOR THE EXPERIMENTS AND EXAMPLES

All materials used in the following examples are readily available from standard commercial sources, such as Aldrich Chemical Co. (Milwaukee, Wis.) unless otherwise specified. All percentages are by weight unless otherwise indicated. The following additional methods and materials were used.

Many of the chemical components used herein are provided as a solution. The term "active ingredient" means the amount or the percentage of the desired chemical component contained in a sample. All amounts listed herein are the amount of active ingredient added unless otherwise specified.

ARQUAD® 12-50 is a 50% solution of 1-dodecyltrimethyl-ammonium chloride in predominantly iso-propanol. ARQUAD® 2HT-75 is di(hydrogenated tallowalkyl)dimethylammonium chloride $[(R)_2(CH_3)_2N^+Cl^-]$. The two hydrogenated tallow groups (R) each contain approximately 4% $C_{14}$, 32% $C_{16}$, and 58% $C_{18}$ aliphatic groups. DUOQUAD® T50 is N,N,N',N',N'-pentamethyl-N-tallow-1,3-propane diammonium dichloride $[R(CH_3)_2N^+—CH_2CH_2CH_2—N^+(CH_3)_3Cl_2^-]$. The hydrogenated tallow group (R) contains approximately 29% $C_{16}$, 25% $C_{18}$, and 38% $C_{18}$ (mono-unsaturated) aliphatic groups. ETHOQUAD® T/13-27W is tris(2-hydroxyethyl)tallowalkyl ammonium acetate $[R(CH_2CH_2OH)_3N^+CH_3CO_2^-]$. The hydrogenated tallow group (R) contains approximately 30% $C_{16}$, 24% $Cl_8$, and 38% $C_{18}$ (mono-unsaturated) aliphatic groups. ETHOQUAD® C/12-75 is cocoalkyl-methylbis(2-hydroxyethyl)ammonium chloride $[R(CH_3)(CH_2CH_2OH)_2N^+Cl^-]$. The cocoalkyl group (R) contains approximately 54% $C_{12}$, 21% $C_{14}$, and 11% $C_{16}$ aliphatic groups. N,N,N,N',N',N'-Hexamethyl-1,3-hexane diammonium dichloride is $[(CH_3)_3N^+—CH_2CH_2CH_2CH_2CH_2CH_2—N^+(CH_3)_3Cl_2^-]$. All are available from Akzo Nobel Surface Chemistry LLC (Chicago, Ill.) (http://surface.akzonobelusa.com).

CAB 381-20 is a cellulose acetate butyrate resin available from Eastman Chemical Co. (Kingsport, Tenn.).

CELNAX® CX-Z641 M is an organosol dispersion containing 60% of non-acicular zinc antimonate particles in methanol. It was obtained from Nissan Chemical America Corporation (Houston, Tex.).

CLOISITE® 15A is a natural montmorillonite that has been modified by reaction with a dimethyl, dihydrogenated-tallow, quaternary ammonium chloride. CLOISITE® $Na^+$ is a natural montmorillonite clay. Sodium is the predominant cation. Both are available from Southern Clay Products (Gonzales, Tex.). (http://www.nanoclay.com).

MEK is methyl ethyl ketone (or 2-butanone).

SLIP-AYD SL 530 is an 18.5% solids dispersion of polyethylene particles in 2-butoxyethanol for use a surface conditioner and is available from Elementis Specialties Performance Additives (Hightstown, N.J.).

SYLOID® 74×6000 is a synthetic amorphous silica that is available from Grace-Davison (Columbia, Md.).

VITEL® PE-2700B LMW is a polyester resin available from Bostik, Inc. (Middleton, Mass.).

Backcoat Dye BC-1 is cyclobutenediylium, 1,3-bis[2,3-dihydro-2,2-bis[[1-oxohexyl)oxy]methyl]-1H-perimidin-4-yl]-2,4-dihydroxy-, bis(inner salt). It is believed to have the structure shown below.

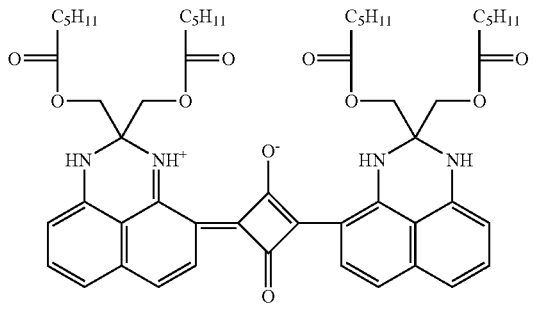

BC-1

Resistivity Measurements

Resistivity of antistatic coatings was measured using three methods, the "ETS decay time" test, the "surface electrode resistivity" (SER) test, and the "water electrode resistivity" (WER) test.

In the "ETS decay time" test, an ETS Model 406D Static Decay Meter (Electro-Tech Systems Inc., Glenside, Pa.) was used to determine the rate of static charge decay on a sample. The sample is subjected to a fixed voltage to induce an electrostatic charge on its surface. The charge is then dissipated (bled off) by providing a path for current flow to ground. The time for the charge to dissipate to certain pre-selected levels (10% in our test) is recorded.

Decay times were measured in a room maintained at 70° F. (21.1° C.)/20% relative humidity (RH) unless otherwise specified. All testing was done in this room after samples had been acclimated for 18 hours. A +5 kV charge was applied and the decay time to reach 10% of the applied charge (90% decay) was recorded. Samples that demonstrate poor antistatic properties do not dissipate charge and their decay times are reported as "not conductive". In order to function as an antistatic material, a compound should provide a coating having a decay time of less than 25 seconds and preferably less than 5 seconds at a temperature of 70° F. (21.1° C.) and a relative humidity of 20%. More preferably, the decay time should be less than 2 seconds and most preferably the decay time should be less than 0.01 seconds.

In the "surface electrode resistivity" (SER) test, three instruments supplied by Keithley Instruments Inc. (Cleveland, Ohio) were used: a Model 247 High Voltage Supply, a Model 480 Digital Picometer, and a Model 6105 Resistivity Adapter. A potential of 500 volts was applied to the sample and the current going through the sample was measured. The conversion from amperes (current) to ohm/sq (resistivity) was calculated using the following equation (provided by Keithley):

$$\text{Ohm/sq}=26{,}7700/\text{amperes}$$

The Keithley Device cannot measure current below $1\times10^{-12}$ amperes. Thus resistivity greater than $2.67\times10^{16}$ ohm/sq (log resistivity 16.43 ohm/sq) cannot be calculated. Films having a log resistivity calculated greater than 16.43 ohm/sq are reported below as >16.43 ohm/sq. In order to function as an antistatic material, a compound should provide a coating having a log resistivity of less than 12 ohm/sq and preferably less than 11 ohm/sq at a temperature of 70° F. (21.1° C.) and a relative humidity of 50%. Measurements were therefore made in rooms maintained at 70° F. (21.1° C.) and 50% relative humidity (RH). Some samples were tested at 70° F. (21.1° C.) and 20% relative humidity (70/20) and/or at 70° F. (21.1° C.) and 80% relative humidity (70/80). All testing was done in this room after samples had been acclimated for 18 to 24 hours.

In the "water electrode resistivity" (WER) test, antistatic performance was evaluated by measuring the internal resistivity of the overcoated electrically conductive antistatic layer using a salt bridge water electrode resistivity measurement technique. This technique is described in R. A. Elder *Resistivity Measurements on Buried Conductive Layers,* EOS/ESD Symposium Proceedings, Lake Buena Vista, Fla., 1990, pp. 251-254, incorporated herein by reference [EOS/ESD stands for Electrical Overstress/Electrostatic Discharge]. Typically, antistatic layers with WER values greater than about $1\times10^{12}$ ohm/square (log resistivity 12 ohm/sq) are considered to be ineffective at providing static protection for photographic imaging elements. WER values of log resistivity 11 ohm/sq or less are preferred. We have also found WER measurements to be more predictive of how an antistatic material will perform when used in a commercial product. WER resistivity was measured in a room maintained at 70° F. (21.1° C.) and 50% relative humidity (RH). All testing was done after samples had been acclimated for 18 to 24 hours.

For buried backside conductive layers, the better measuring technique is their water electrode resistivity (WER). For materials where the backside conductive layer is the surface layer, the WER and SER should be essentially the same. For buried conductive layers however, WER measurement removes the influence of any protective overcoats on the measured resistivity. Adhesion Test:

Samples were evaluated using a "cross-hatch" adhesion test performed according to ASTM D3359-92A. A coated film was cut with a razor blade in a cross-hatched pattern, a 1 inch (2.54 cm) wide piece of commercially available 3M Type 610 semi-transparent pressure-sensitive tape was placed on the pattern and then quickly lifted off. The amount of coating left on the film is the measure of adhesion. The adhesion test ratings are from 0 to 5 where 0 refers to complete removal of the coating and 5 refers none or very little coating removed. A rating of "3" or greater is considered to be acceptable. 3M Type 610 semi-transparent pressure-sensitive tape was obtained from 3M Company (Maplewood, Minn.).

Comparative Example 1

Buried Backside Conductive Layer Formulation

A backside conductive layer formulation containing zinc antimonate clusters was prepared as described in U.S. Pat. No. 7,067,242 (Ludeman et al.) and also described below.

A dispersion was prepared by adding 16.88 parts of MEK to 7.92 parts of CELNAX® CX-Z641M (containing 60% non-acicular zinc antimonate solids in methanol—4.75 parts net). The addition took place over 15 minutes. Strong stirring was maintained for an additional 15 minutes.

A polymer solution was prepared by dissolving 0.35 parts of VITEL® PE-2700B LMW and 1.40 parts of CAB 381-20 in 41.25 parts of MEK.

The polymer solution was added to the CELNAX® CX-Z641M dispersion over 15 minutes with strong mixing. An additional 32.21 parts of MEK was then added over 5 minutes. Mixing was continued for 10 minutes. The final formulation had a viscosity of 5 cP (centipoise) and a specific gravity of 0.84.

Outermost First Backside Layer Formulation

A solution of 54.79 parts of MEK, 21.63 parts of methanol, and 12.17 parts of Eastman CAB 381-20 was prepared.

A solution of 0.16 parts of Backcoat Dye-1 (BC-1) and 0.38 parts of SYLOID® 74×6000 in 7.36 parts of MEK was prepared. This solution was subjected to high-shear stirring for 15 minutes and added to the polymer solution.

A dispersion of 1.27 parts MEK, 0.24 parts CLOISITE® 15A, and 0.49 parts of Slip-Ayd SL 530 (18% solids) was prepared. This dispersion was subjected to high-shear stirring for 15 minutes and added to the polymer solution.

Preparation of Backside Coatings

The buried backside conductive layer formulation and first backside layer formulation were simultaneously coated onto one side of a 7 mil (178 μm) blue tinted poly(ethylene terephthalate) support using a precision automated multilayer slide coater equipped with an in-line dryer. The backside coatings were dried at approximately 60° C. for 4 minutes. Four thickness of buried backside conductive layer were coated to compare conductivity at different levels of CELNAX® CX-Z641M. Coating weights were determined by X-ray fluorescence (XRF). The dry coating weight of the first backside topcoat layer was 2 g/m$^2$.

Evaluation of Samples

The water electrode resistivity of all samples was evaluated at 70° F. (21.1° C.) at 20%, 50%, and 80% relative humidity. The results, shown below in TABLE I, indicate that below a coating weight of about 158 mg/M$^2$ conductivity becomes unacceptable.

TABLE I

CELNAX ® CX-Z641M in Buried Backside Conductive Layer

| Sample | Celnax ® Coating Weight (by XRF) ($mg/m^2$) | WER @ 20% RH (log ohm/sq) | WER @ 50% RH (log ohm/sq) | WER @ 80% RH (log ohm/sq) |
|---|---|---|---|---|
| 1-1-Comparative | 187 | 9.4 | 9.2 | 9.2 |
| 1-2-Comparative | 158 | 12.1 | 11.9 | 11.5 |
| 1-3-Comparative | 133 | 13.0 | 13.0 | 13.3 |
| 1-4-Comparative | 107 | 13.8 | 13.5 | 14.2 |

Inventive Example 1

Use of Quaternary Ammonium Salts in the First Backside Layer

Buried Backside Non-Conductive Layer Formulation

A polymer solution was prepared by dissolving 0.35 parts of VITEL® PE-2700B LMW and 1.39 parts of Eastman CAB 381-20 in 90.34 parts of MEK to form a solution containing 1.89% solids.

Outermost First Backside Layer Formulation

A solution of 39.25 parts of MEK, 39.15 parts of methanol, and 12.17 parts of Eastman CAB 381-20 was prepared.

A solution of 0.16 parts of Backcoat Dye-1 (BC-1) and 0.38 parts of SYLOID® 74×6000 in 7.37 parts of MEK was prepared. This solution was subjected to high-shear mixing for 15 minutes and added to the polymer solution.

A dispersion of 0.24 parts Cloisite $Na^+$ in 1.27 parts of MEK was prepared. This dispersion was subjected to high-shear stirring, for 15 minutes and added to the polymer solution.

1-Dodecyltrimethylammonium chloride (ARQUAD® 12-50), 3.88 parts (50% in iso-propanol) was then added. Stirring was maintained for an additional 15 minutes.

Slip-Ayd SL 530, 0.49 parts (18% solids) was then added. Stirring was maintained for an additional 15 minutes.

Preparation of Backside Coatings

The buried backside layer formulation and first backside layer formulation were simultaneously coated onto one side of a 7 mil (178 μm) blue tinted poly(ethylene terephthalate) support using a precision automated multilayer slide coater equipped with an in-line dryer. The backside coatings were dried at approximately 60° C. for 4 minutes. The buried backside layer was coated to achieve coating weights of 0.269, 0.215, and 0.161 $g/m^2$. A first backside layer were coated to achieve the coating weights of quaternary ammonium salts shown in TABLE II.

Evaluation of Samples

The Water Electrode Resistivity and Surface Electrode Resistivity of all samples were evaluated at 70° F. (21.1° C.) at 20%, 50%, and 80% relative humidity. The results, shown below in TABLES II, III, and IV, demonstrate that a first layer containing only a quaternary ammonium salt is effective in providing materials with acceptable resistivity even at a low coating weight of quaternary ammonium salt of 0.25 $g/m^2$.

TABLE II

Quaternary Ammonium Compound in First Backside Layer

| Sample | Coating Weight Buried Backside Layer - ($g/m^2$) | Coating Weight First Backside Layer - ($g/m^2$) | Coating Weight of Quaternary Ammonium Salt ($g/m^2$) | Coating Weight Celnax ($g/m^2$) |
|---|---|---|---|---|
| 1-1-Inventive | 0.269 | 2.15 | 0.25 | None |
| 1-2-Inventive | 0.215 | 2.15 | 0.25 | None |
| 1-3-Inventive | 0.161 | 2.15 | 0.25 | None |

TABLE III

Quaternary Ammonium Compound in First Backside Layer

| Sample | WER @ 20% RH (log ohm/sq) | WER @ 50% RH (log ohm/sq) | WER @ 80% RH (log ohm/sq) | ETS Decay Time (sec) |
|---|---|---|---|---|
| 1-1-Inventive | 9.4 | 9.1 | 8.5 | 0.7 |
| 1-2-Inventive | 9.7 | 9.1 | 8.5 | 5.5 |
| 1-3-Inventive | 11.3 | 10.1 | 8.6 | 14.8 |

TABLE IV

Quaternary Ammonium Compound in First Backside Layer

| Sample | SER at 20% RH (log ohm/sq) | SER at 50% RH (log ohm/sq) | SER at 80% RH (log ohm/sq) |
|---|---|---|---|
| 1-1-Inventive | 10.06 | 9.75 | 9.03 |
| 1-2-Inventive | 10.73 | 10.11 | 9.15 |
| 1-3-Inventive | 11.87 | 10.11 | 9.10 |

Inventive Example 2

Evaluation of Additional Quaternary Ammonium Salts

Additional quaternary ammonium salts were evaluated for their antistatic properties by incorporating them into first layer formulations and coating them directly onto untreated polyethylene terephthalate. In this example, no buried backside layer was used.

First Backside Layer Formulation

A first backside layer formulation was prepared by mixing 23.25 parts of MEK, 69.75 parts of methanol, 7.00 parts of Eastman CAB-381-20, and the amount of quaternary ammonium salt shown below in TABLE III.

Preparation of Backside Coatings

All formulations were coated at a wet thickness of 2.4 mil (61 μm) directly onto a 7 mil (178 μm) unprimed blue-tinted polyethylene support using a laboratory scale automated knife coater equipped with an in-line drier. Samples were dried for 3.5 minutes at 93° C. The dry coating weight of the first backside layer was 2.15 g/m$^2$.

Evaluation of Samples The Water Electrode Resistivity of all samples was evaluated at 70° F. (21.1° C.) and 50% relative humidity. The Surface Electrode Resisitivity was evaluated at 70° F. (21.1° C.) and 20%, 50%, and 80% relative humidity. ETS Decay Time at 70° F. (21.1° C.)/20% RH was also measured.

The results, shown below in TABLE V, demonstrate that many quaternary ammonium salts used as the sole conductive agents are effective in providing outermost backside layers with acceptable resistivity. The results also demonstrate that chloride is preferred as the anion over bromide and iodide and that shorter aliphatic chains are preferred when bromide is the anion. In addition, for some of the compounds studied, the Water Electrode Resistivity and ETS Decay Time Tests appear to be better predictors of performance than the Surface Electrode Resistivity Test.

TABLE V

| Sample | Quaternary Ammonium Compound | Coating Weight of Quaternary Ammonium Salt (g/m$^2$) | ETS Decay Time (sec) | WER at 50% RH (log ohm/sq) | SER at 50% RH (log ohm/sq) |
|---|---|---|---|---|---|
| 2-1-Comparative | Tetramethylammonium chloride | 0.084 | >100 | 13.0 | 14.9 |
| 2-2-Comparative | Tetramethylammonium chloride | 0.114 | >100 | 13.4 | 15.9 |
| 2-3-Comparative | Tetramethylammonium chloride | 0.156 | >100 | 14.1 | 15.5 |
| 2-4-Comparative | Tetramethylammonium chloride | 0.190 | >100 | 13.5 | 15.5 |
| 2-5-Comparative | Tetramethylammonium chloride | 0.224 | >100 | 12.2 | 14.9 |
| 2-6-Comparative | Tetramethylammonium chloride | 0.258 | >100 | 11.0 | 15.7 |
| 2-7-Inventive | Decyltrimethyl ammonium chloride | 0.581 | 0.01 | 7.6 | 9.5 |
| 2-8-Inventive | Dodecyltrimethylammonium chloride | 0.156 | 0.05 | 8.7 | 9.8 |
| 2-9-Inventive | Dodecyltrimethylammonium chloride | 0.190 | 0.01 | 8.8 | 9.7 |
| 2-10-Inventive | Dodecyltrimethylammonium chloride | 0.224 | 0.01 | 8.8 | 9.3 |
| 2-11-Inventive | Dodecyltrimethylammonium chloride | 0.258 | 0.01 | 8.1 | 9.4 |
| 2-12-Inventive | Dodecyltrimethylammonium chloride | 0.581 | 0.01 | 7.8 | 8.9 |
| 2-13-Inventive | Tetradecyltrimethylammonium chloride | 0.581 | 0.02 | 7.7 | 9.3 |
| 2-14-Inventive | Octadecyltrimethylammonium chloride | 0.581 | 11.88 | 10.0 | 10.4 |
| 2-15-Inventive | Hexyltrimethylammonium bromide | 0.581 | 0.21 | 8.8 | 11.2 |
| 2-16-Inventive | Octyltrimethylammonium bromide | 0.581 | 1.18 | 8.8 | 11.3 |
| 2-17-Inventive | Tetradecyltrimethylammonium bromide | 0.581 | >100 | 11.4 | 14.1 |
| 2-18-Inventive | Hexadecyltrimethyl ammonium bromide | 0.581 | >100 | 12.7 | 13.5 |
| 2-19-Inventive | Octadecyltrimethyl ammonium bromide | 0.581 | 2 | 11.9 | 13.4 |
| 2-20-Comparative | Hexadecylammonium fluoroborate | 0.581 | >100 | 13.5 | 15.6 |
| 2-21-Comparative | Tetraethylammonium iodide | 0.581 | 95 | 11.5 | 13.6 |
| 2-22-Comparative | Tetrabutylammonium nitrate | 0.581 | 10.22 | 11.4 | 13.2 |
| 2-23-Inventive | N,N-Bis(2-hydroxy ethyl)-N-methyl-9-octadecenyl-1-ammonium chloride | 0.581 | 0.04 | 9.1 | 10.8 |

TABLE V-continued

| Sample | Quaternary Ammonium Compound | Coating Weight of Quaternary Ammonium Salt ($g/m^2$) | ETS Decay Time (sec) | WER at 50% RH (log ohm/sq) | SER at 50% RH (log ohm/sq) |
|---|---|---|---|---|---|
| 2-24-Comparative | Benzylcetyldimethylammonium chloride | 0.581 | >100 | 13.7 | 14.8 |
| 2-25-Comparative | Benzyldimethyltetradecyl-ammonium chloride | 0.581 | >100 | 12.4 | 14.6 |
| 2-26-Comparative | Cetylpyridinium chloride | 0.581 | 12.03 | 11.1 | 13.6 |
| 2-27-Inventive | ARQUAD ® 2HT-75 | 0.581 | 1.30 | 9.9 | 12.3 |
| 2-28-Inventive | ETHOQUAD ® T/13-27W | 0.581 | 10.82 | 8.4 | 10.8 |
| 2-39-Inventive | ETHOQUAD ® C/12-75 | 0.581 | 0.01 | 8.2 | 11.8 |
| 2-29-Inventive | Hexane-1,6-bis(trimethyl-ammonium) chloride | 0.581 | 3.88 | 9.4 | 12.7 |
| 2-31-Inventive | DUOQUAD ® T50 | 0.581 | 0.01 | 6.8 | 8.2 |
| 2-32-Comparative | Dimethyloctyldecyl-(3 sulfo-propyl)ammonium hydroxide | 0.581 | >100 | 13.5 | 15.5 |
| 2-33-Comparative | N-Hexadecyl-N-N-Dimethyl-3-ammonio-1-propane sulfonate | 0.581 | >100 | 12.8 | 15.8 |
| 2-34-Inventive | N,N,N,N',N',N'-Hexamethyl-1,3-hexane diammonium dichloride | 0.581 | 3.88 | 9.4 | 12.7 |

Inventive Example 3

Metal Oxide in Buried Backside Layer and Quaternary Ammonium Salts in First Backside Layer Buried Backside Conductive Layer Formulation A backside conductive layer formulation containing zinc antimonate clusters was prepared as described in copending and commonly assigned U.S. Ser. No. 10/978,205 (filed Oct. 29, 2004 by Ludemann, LaBelle, Koestner, and Chen) and also described below.

A dispersion was prepared by adding 16.88 parts of MEK to 7.92 parts of CELNAX® CX-Z641M (containing 60% non-acicular zinc antimonate solids in methanol—4.75 parts net). The addition took place over 15 minutes. Strong stirring was maintained for an additional 15 minutes.

A polymer solution was prepared by dissolving 0.35 parts of VITEL® PE-2700B LMW and 1.40 parts of CAB 381-20 in 41.25 parts of MEK.

The polymer solution was added to the CELNAX® CX-Z641M dispersion over 15 minutes with strong mixing. An additional 32.21 parts of MEK was then added over 5 minutes. Mixing was continued for 10 minutes. The final formulation had a viscosity of 5 cP (centipoise) and a specific gravity of 0.84.

Outermost First Layer Formulations

Two outermost first backside layer formulations were prepared.

A solution of 45.26 parts of MEK, 47.18 parts of methanol, and 12.84 parts of Eastman CAB 381-20 was prepared.

A solution of 0.16 parts of Backcoat Dye-1 (BC-1) and 0.35 parts of SYLOID® 74×6000 in 9.01 parts of MEK was prepared. This solution was subjected to high-shear stirring for 15 minutes and added to the polymer solution.

A dispersion of 3.39 parts MEK, 0.24 parts CLOISITE® $Na^+$, and 0.51 parts of Slip-Ayd SL 530 (18% solids) was prepared. This dispersion was subjected to high-shear stirring for 15 minutes and added to the polymer solution. This solution was split in half and 2.06 g of 1-dodecyltrimethylammonium chloride (ARQUAD® 12-50) was added to the second portion. No quaternary ammonium salt was added to the first portion. It served as a control.

Preparation of Backside Coatings

The buried backside layer formulation and first backside layer formulation were simultaneously coated onto one side of a 7 mil (178 μm) blue tinted poly(ethylene terephthalate) support using a precision automated multilayer slide coater equipped with an in-line dryer. The backside coatings were dried at approximately 60° C. for 4 minutes. Four thickness of a buried backside conductive layer were coated to compare conductivity at different levels of CELNAX® CX-Z641M. Coating weights were determined by X-ray fluorescence (XRF). The dry coating weight of the outermost first backside layer was 2.15 $g/m^2$.

Evaluation of Samples

The Water Electrode Resistivity (WER) of all samples was evaluated at 70° F. (21.1° C.) at 20%, 50%, and 80% relative humidity. The Surface Electrode Resistivity (SER) was evaluated at 70° F. (21.1 C.) and 20%, 50%, and 80% relative humidity.

The results, shown below in TABLES VI and VII demonstrate that the addition of a quaternary ammonium salt to the first backside layer provides an increase in conductivity above that provided by a metal oxide buried backside conductive layer used alone. The results further demonstrate that addition of a quaternary ammonium salt to the first backside layer allows the amount of metal oxide to be reduced while still maintaining excellent conductivity.

TABLE VI

| Sample | Celnax ® Coating Weight ($mg/m^2$) | Quaternary Ammonium Salt Coating Weight ($mg/m^2$) | WER at 20% RH (log ohm/sq) | WER at 50% RH (log ohm/sq) | WER at 80% RH (log ohm/sq) |
|---|---|---|---|---|---|
| 3-1-Inventive | 193 | 0.27 | 9.09 | 8.86 | 8.05 |
| 3-2-Comparative | 194 | 0.00 | 11.01 | 10.88 | 10.72 |
| 3-3-Inventive | 152 | 0.27 | 9.06 | 8.70 | 7.71 |
| 3-4-Comparative | 159 | 0.00 | 12.44 | 12.16 | 12.53 |
| 3-5-Inventive | 133 | 0.27 | 9.13 | 8.71 | 7.56 |
| 3-6-Comparative | 131 | 0.00 | 12.71 | 13.71 | 13.64 |
| 3-7-Inventive | 102 | 0.27 | 9.10 | 9.11 | 7.49 |
| 3-8-Comparative | 101 | 0.00 | 12.81 | 13.29 | 13.85 |

TABLE VII

| Sample | Celnax ® Coating Weight ($mg/m^2$) | Quaternary Ammonium Salt Coating Weight ($mg/m^2$) | SER at 20% RH (log ohm/sq) | SER at 50% RH (log ohm/sq) | SER at 80% RH (log ohm/sq) |
|---|---|---|---|---|---|
| 3-1-Inventive | 193 | 0.27 | 9.90 | 9.46 | 8.47 |
| 3-2-Comparative | 194 | 0.00 | 12.37 | 12.34 | 11.85 |
| 3-3-Inventive | 152 | 0.27 | 9.93 | 9.41 | 8.31 |
| 3-4-Comparative | 159 | 0.00 | 16.03 | 15.20 | 13.58 |
| 3-5-Inventive | 133 | 0.27 | 9.86 | 9.30 | 8.21 |
| 3-6-Comparative | 131 | 0.00 | 16.31 | 15.28 | 13.73 |
| 3-7-Inventive | 102 | 0.27 | 9.91 | 9.44 | 8.26 |
| 3-8-Comparative | 101 | 0.00 | 15.95 | 15.61 | 13.76 |

The invention has been described in detail with particular reference to certain preferred embodiments thereof, but it will be understood that variations and modifications can be effected within the spirit and scope of the invention.

The invention claimed is:

1. A thermally developable material that comprises a support having on one side thereof, one or more thermally developable imaging layers comprising a binder, said material also comprising, in reactive association, a non-photosensitive source of reducible silver ions, and a reducing agent composition for said non-photosensitive source of reducible silver ions, and having disposed on the backside of said support, a first non-imaging backside layer comprising at least 0.0004 $mol/m^2$ of one or more a quaternary ammonium salts having a molecular weight less than 650 and comprising four aliphatic organic groups attached to the quaternary ammonium cation, provided at least one of said organic groups is an aliphatic group having 6 to 20 carbon atoms and at least two of said organic groups are the same or different aliphatic groups having 1 to 5 carbon atoms, and a buried conductive backside layer, said buried conductive backside layer being closer to said support than said first backside layer, and wherein said quaternary ammonium salt is located only in said first backside layer.

2. The material of claim 1 wherein said first backside layer is the outermost protective layer.

3. The material of claim 1 wherein said buried conductive backside layer further comprises particles of a conductive metal oxide or a conductive polymer.

4. The material of claim 1 wherein said buried conductive backside layer comprises conductive metal oxide particles that are non-acicular metal antimonate particles.

5. The material of claim 4 wherein said non-acicular metal antimonate particles are dispersed in a one or more binder polymers, wherein said non-acicular metal antimonate particles comprise greater than 55 and up to 85% by dry weight of said buried conductive backside layer, are present at a coverage of from about 0.06 to about 0.5 $g/m^2$, and the ratio of total binder polymers in said buried backside layer to said non-acicular metal antimonate particles is less than 0.75:1, based on dry weight.

6. The material of claim 1 wherein said quaternary ammonium salt can be represented by the following Structure (I):

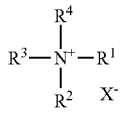

(I)

wherein at least one of $R^1$, $R^2$, $R^3$, and $R^4$ is an independently substituted or unsubstituted aliphatic group having 6 to 20 carbon atoms, or mixtures thereof, at least two of $R^1$, $R^2$, $R^3$ and $R^4$ are independently substituted or unsubstituted aliphatic groups having 1 to 5 carbon atoms, and $X^-$ is iodide, bromide, chloride, acetate, or nitrate.

7. The material of claim 6 wherein $R^1$ is an alkyl group having 10 to 20 carbon atoms, $R^2$, $R^3$, and $R^4$ are independently alkyl groups having 1 to 5 carbon atoms, and $X^-$ is chloride.

8. The material of claim 1 wherein said quaternary ammonium salt is one or more of decyltrimethylammonium chloride, dodecyltrimethyl-ammonium chloride, tetradecyltrimethylammonium chloride, octadecyltrimethyl-ammonium chloride, and N,N,N',N',N'-pentamethyl-N-tallow-1,3-propane diammonium dichloride.

9. The material of claim 1 wherein said quaternary ammonium salt is present in an amount of from about 0.0004 to about 0.0025 mol/$m^2$.

10. The material of claim 1 wherein:

a) said first non-imaging backside layer comprises a film-forming polymer and one or more quaternary ammonium salts, and b) said buried conductive backside layer being interposed between said support and said first non-imaging backside layer and directly adhering said first non-imaging backside layer to said support, said buried conductive backside layer comprising non-acicular metal antimonate particles in a mixture of two or more polymers that include a first polymer serving to promote adhesion of said buried conductive backside layer directly to said support, and a second polymer that is different than and forms a single phase mixture with said first polymer, wherein said film-forming polymer of said first non-imaging backside layer and said second polymer of said buried conductive backside layer are the same or different polyvinyl acetal resins, polyester resins, cellulosic polymers, maleic anhydride-ester copolymers, or vinyl polymers.

11. The material of claim 10 wherein said film-forming polymer of said first non-imaging backside layer and said second polymer of said buried conductive backside layer are the same or different polyvinyl acetal resin or cellulosic ester polymer, and said first polymer is a polyvinyl acetal, cellulosic ester polymer, polyvinyl chloride, polyvinyl acetate, epoxy resin, polyester resin, polystyrene, polyacrylonitrile, polycarbonate, acrylate or methacrylate polymer, maleic anhydride ester copolymer, or butadiene-styrene polymer.

12. The material of claim 11 wherein said buried conductive backside layer comprises a single-phase mixture of a polyester resin with either polyvinyl butyral or cellulose acetate butyrate.

13. The material of claim 1 wherein said non-photosensitive source of reducible silver ions is a silver salt of an aliphatic carboxylate or a mixture of silver salts of aliphatic carboxylates, at least one of which is silver behenate.

14. The material of claim 1 that is a light sensitive photo-thermographic material further comprising a photosensitive silver halide.

15. A method of forming a visible image comprising:

A) imagewise exposing the material of claim 1 that is a photothermographic material to electromagnetic radiation to form a latent image, and B) simultaneously or sequentially, heating said exposed photothermographic material to develop said latent image into a visible image.

16. A method of forming a visible image comprising thermal imaging of the material of claim 1 that is a thermographic material.

17. A dry processable black-and-white photothermographic material that comprises a support having on one side thereof, one or more photothermographic layers comprising a binder, said material further comprising, in reactive association, a preformed photosensitive silver halide, a non-photosensitive source of reducible silver ions comprising at least one silver salt of a fatty acid, and a reducing agent composition for said non-photosensitive source reducible silver ions, and having disposed on the backside of said support:

a) a first non-imaging backside layer comprising a film-forming polymer, and b) interposed between said support and said first non-imaging backside layer and directly adhering said first non-imaging backside layer to said support, a buried conductive backside layer comprising non-acicular metal antimonate particles in a mixture of two or more polymers that include a first polymer serving to promote adhesion of said buried conductive backside layer directly to said support, and a second polymer that is different than and forms a single phase mixture with said first polymer, wherein said non-acicular metal antimonate particles are composed of zinc antimonate ($ZnSb_2O_6$) and comprise greater than 70 and up to 76% by dry weight of said buried conductive backside layer, are present at a coverage of from about 0.06 to about 0.2 g/$m^2$, and the ratio of total binder polymers in said buried conductive backside layer to said non-acicular metal antimonate particles is less than 0.75:1, based on dry weights, and the dry thickness of said buried conductive backside layer is from about 0.09 to about 0.2 μm, wherein said film-forming polymer of said first non-imaging backside layer and said second polymer of said buried conductive backside layer are the same or different polyvinyl acetal resins, polyester resins, cellulosic polymers, maleic anhydride-ester copolymers, or vinyl polymers, and said first non-imaging backside layer further comprises from about 0.0004 to about 0.0025 mol/$m^2$ of a quaternary ammonium salt that can be represented by the following Structure (I):

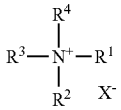

(I)

wherein $R^1$ is an alkyl group having 6 to 20 carbon atoms, and $R^2$, $R^3$ and $R^4$ independently alkyl groups having 1 to 5 carbon atoms, and $X^-$ is chloride.

18. The material of claim 17 wherein said first non-imaging backside layer further comprises an antihalation composition, and said material has an optical density of from about 0.2 to about 3.5 on the imaging layer side of said support or an optical density of up to 2 on the backside of said support.

* * * * *